US008735040B2

(12) United States Patent
Amemori et al.

(10) Patent No.: US 8,735,040 B2
(45) Date of Patent: May 27, 2014

(54) TONER, DEVELOPER, AND IMAGE FORMING APPARATUS

(71) Applicants: Suzuka Amemori, Shizuoka (JP); Masahide Yamada, Shizuoka (JP); Yoshihiro Moriya, Shizuoka (JP); Taichi Nemoto, Shizuoka (JP); Yukiko Nakajima, Kanagawa (JP); Yoshitaka Yamauchi, Shizuoka (JP); Daiki Yamashita, Kanagawa (JP); Keiji Makabe, Shizuoka (JP); Akiyoshi Sabu, Shizuoka (JP)

(72) Inventors: Suzuka Amemori, Shizuoka (JP); Masahide Yamada, Shizuoka (JP); Yoshihiro Moriya, Shizuoka (JP); Taichi Nemoto, Shizuoka (JP); Yukiko Nakajima, Kanagawa (JP); Yoshitaka Yamauchi, Shizuoka (JP); Daiki Yamashita, Kanagawa (JP); Keiji Makabe, Shizuoka (JP); Akiyoshi Sabu, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/728,060

(22) Filed: Dec. 27, 2012

(65) Prior Publication Data

US 2013/0171550 A1 Jul. 4, 2013

(30) Foreign Application Priority Data

Dec. 28, 2011 (JP) ..... 2011-288511

(51) Int. Cl.
*G03G 9/087* (2006.01)

(52) U.S. Cl.
USPC ..... 430/109.4

(58) Field of Classification Search
USPC ..... 430/109.4, 109.1; 399/252
See application file for complete search history.

(56) References Cited

U.S. PATENT DOCUMENTS

| | | | | |
|---|---|---|---|---|
| 2001/0003636 | A1 | 6/2001 | Suwa et al. | |
| 2008/0227002 | A1 | 9/2008 | Moriya et al. | |
| 2009/0003885 | A1* | 1/2009 | Sabu et al. | 399/252 |
| 2010/0104965 | A1 | 4/2010 | Inoue et al. | |
| 2010/0330489 | A1 | 12/2010 | Inoue et al. | |
| 2011/0065036 | A1 | 3/2011 | Inoue et al. | |
| 2011/0104608 | A1 | 5/2011 | Nakajima et al. | |
| 2011/0124838 | A1 | 5/2011 | Kotsugai et al. | |
| 2011/0129775 | A1 | 6/2011 | Sawada et al. | |
| 2011/0281213 | A1 | 11/2011 | Sakashita et al. | |
| 2012/0065357 | A1 | 3/2012 | Yamauchi et al. | |
| 2012/0282000 | A1 | 11/2012 | Nakayama et al. | |
| 2012/0295188 | A1 | 11/2012 | Nakajima et al. | |

FOREIGN PATENT DOCUMENTS

| | | |
|---|---|---|
| EP | 0640882 | 3/1995 |
| JP | 59-096123 | 6/1984 |
| JP | 2909873 | 4/1999 |
| JP | 3347406 | 9/2002 |
| JP | 2004-310018 | 11/2004 |
| JP | 3785011 | 3/2006 |
| JP | 2008-262179 | 10/2008 |

OTHER PUBLICATIONS

Diamond, A.S. ed., et al., Handbook of Imaging Materials, second edition, Marcel Dekker, Inc., NY (2002), pp. 146-148.*
U.S. Appl. No. 13/565,025, Yoshihiro Moriya, et al.

* cited by examiner

*Primary Examiner* — Janis L Dote

(74) *Attorney, Agent, or Firm* — Oblon, Spivak, McClelland, Maier & Neustadt, L.L.P.

(57) ABSTRACT

To provide a toner including at least a binder resin and a colorant, wherein the binder resin has two glass transition temperatures Tg1 and Tg2 in a differential scanning calorimetry at a heating speed of 5° C./min, the glass transition temperature Tg1 is −20° C. to 20° C., and the glass transition temperature Tg2 is 35° C. to 65° C., wherein the binder resin comprises a polyester skeleton and a ring-containing skeleton molecule at ends thereof, and wherein the binder resin is obtained by block copolymerization of:

a polyester skeleton A which includes a structural unit obtained by dehydration condensation of a hydroxycarboxylic acid in a repeating structure; and a skeleton B which does not include a structural unit obtained by dehydration condensation of a hydroxycarboxylic acid in a repeating structure.

8 Claims, 8 Drawing Sheets

TONER, DEVELOPER, AND IMAGE FORMING APPARATUS

BACKGROUND OF THE INVENTION

1. Field of the Invention

The present invention relates to a toner, a developer, and an image forming apparatus.

2. Description of the Related Art

Conventionally, in an electrophotographic apparatus, an electrostatic recording apparatus, etc., an electrical or magnetic latent image is visualized with a toner. For example, in electrophotography, an electrostatic image (latent image) is formed on a photoconductor, then the latent image is developed using a toner, and a toner image is formed. The toner image is usually transferred on a recording medium such as paper, and then fixed by a method such as heating.

A resin binder accounts for over 70% of the components of such a toner, most of which uses petroleum resources as a raw material. Problems such as exhaustion of petroleum resources in the future and global warming caused by carbon dioxide discharged into the atmosphere due to mass consumption of petroleum resources are concerned. Thus, if a toner binder is made of an environmental cycling polymer that a plant which grows by taking in carbon dioxide in an atmosphere, carbon dioxide generated thereby merely circulates in the environment. Thus, suppression of global warming and depletion of petroleum resources may be simultaneously solved. Accordingly, a polymer made of botanical resources (biomass) is gaining attention.

As an attempt to use such a plant-derived resin as a toner binder, for example, in Japanese Patent (JP-B) No. 2909873, use of a polylactic acid as a binder resin is proposed. This polylactic acid is readily available for general use as a polymer made of botanical resources, and it is synthesized by dehydration condensation of a lactic acid monomer or by ring-opening polymerization of a cyclic lactide of a lactic acid (see JP-B No. 3347406 and Japanese Patent Application Laid-Open (JP-A) No. 59-96123). However, when the polylactic acid is used for a toner as it is, it is difficult to obtain all the physical properties required for a toner only by the polylactic acid because it has high ester group concentration compared to a polyester resin and a molecular chain which is through an ester bond is a carbon atom only (N=1).

To solve this, it is considered to ensure physical properties and thermal properties required for a toner by (1) mixing the polylactic acid and a second resin other than the polylactic acid, or by (2) copolymerizing the polylactic acid. To improve the thermal properties, for example, in JP-B No. 3785011, inclusion of a terpene phenol copolymer in a polylactic acid resin as a low-molecular-weight component is proposed. However, this proposal does not satisfy both low-temperature fixing property and hot offset property, and has not yet been put into practical use. Also, the polylactic acid resin has extremely poor compatibility or dispersibility with a polyester resin and a styrene-acrylic copolymer commonly used for a toner. In the case of combining it with other resins, controlling a composition of an outermost surface which assumes important features of the toner such as storage stability, charging property and fluidity becomes extremely difficult.

Meanwhile, as an example of an attempt to solve the problem by copolymerization, a block copolymerization resin with a polyester resin other than a polylactic acid skeleton of which a D/L ratio of polylactic acids are defined is proposed (JP-A No. 2008-262179). Since about half or more of energy consumption in an electrophotographic image forming apparatus is consumed for heating a toner in a thermal fixing system, market demand not only for a fixing apparatus with low-power consumption but also for a toner which enables low-temperature fixing has further increased in recent years. To this demand, satisfactory properties cannot be obtained with the toner of JP-A No. 2008-262179, and even with a polymer made of botanical resources, improvement for further low-temperature fixing property has been desired.

Also, among toner properties, low-temperature fixing property and heat-resistant storage stability have a trade-off relationship, and there is a problem that decreasing thermal properties for achieving low-temperature fixing property involves degradation of heat-resistant storage stability. For example, in JP-A No. 2004-310018, a high-molecular-weight polyester resin obtained by elongation of a prepolymer is used in combination with a low-molecular-weight polyester resin as a binder resin of a toner. It is considered that the low-molecular-weight polyester resin contributes to low-temperature fixing property and that the high-molecular-weight polyester resin contributes to hot-offset resistance and heat-resistant storage stability, but in reality, the high-molecular-weight polyester inhibits fixing of the toner to paper, and sufficient low-temperature fixing property cannot be obtained. Thus, it is difficult to obtain both low-temperature fixing property and heat-resistant storage stability of a toner simply by combining a low-molecular-weight resin and a high-molecular-weight resin as a binder resin of a toner.

Also, decreasing thermal properties for achieving low-temperature fixing property not only invites degradation of heat-resistant storage stability but also reduction of resin hardness. Reduction of resin hardness affects image quality since mechanical loads such as agitation and compression applies on a toner not only during long-term storage in a standing state but also as a mechanical load inside a printer during continuous printing.

Accordingly, a toner using a binder resin with a polylactic acid skeleton which has superior low-temperature fixing property and heat-resistant storage stability and provides less reduction of toner performance during continuous printing and related technologies thereof has not yet been obtained, and further improvement and development has been currently desired.

SUMMARY OF THE INVENTION

The present invention aims at providing a toner which has superior low-temperature fixing property and heat-resistant storage stability and enables to obtain high-quality image without causing toner scattering and background smear during continuous printing.

Means for solving the problems are as follows. That is:

a toner of the present invention includes at least a binder resin and a colorant, wherein the binder resin has two glass transition temperatures Tg1 and Tg2 in a differential scanning calorimetry at a heating speed of 5° C./min, the glass transition temperature Tg1 is −20° C. to 20° C., and the glass transition temperature Tg2 is 35° C. to 65° C., wherein the binder resin includes a polyester skeleton and a ring-containing skeleton molecule at ends thereof, and wherein the binder resin is obtained by block copolymerization of:

- a polyester skeleton A which includes a structural unit obtained by dehydration condensation of a hydroxycarboxylic acid in a repeating structure; and
- a skeleton B which does not include a structural unit obtained by dehydration condensation of a hydroxycarboxylic acid in a repeating structure.

According to the present invention, a toner which may solve the conventional problems and may achieve the object of low-temperature fixing property, has superior heat-resistant storage stability and provides high-quality image without causing toner scattering and background smear during continuous printing may be provided.

DETAILED DESCRIPTION OF THE INVENTION (Toner)

Figure 1:
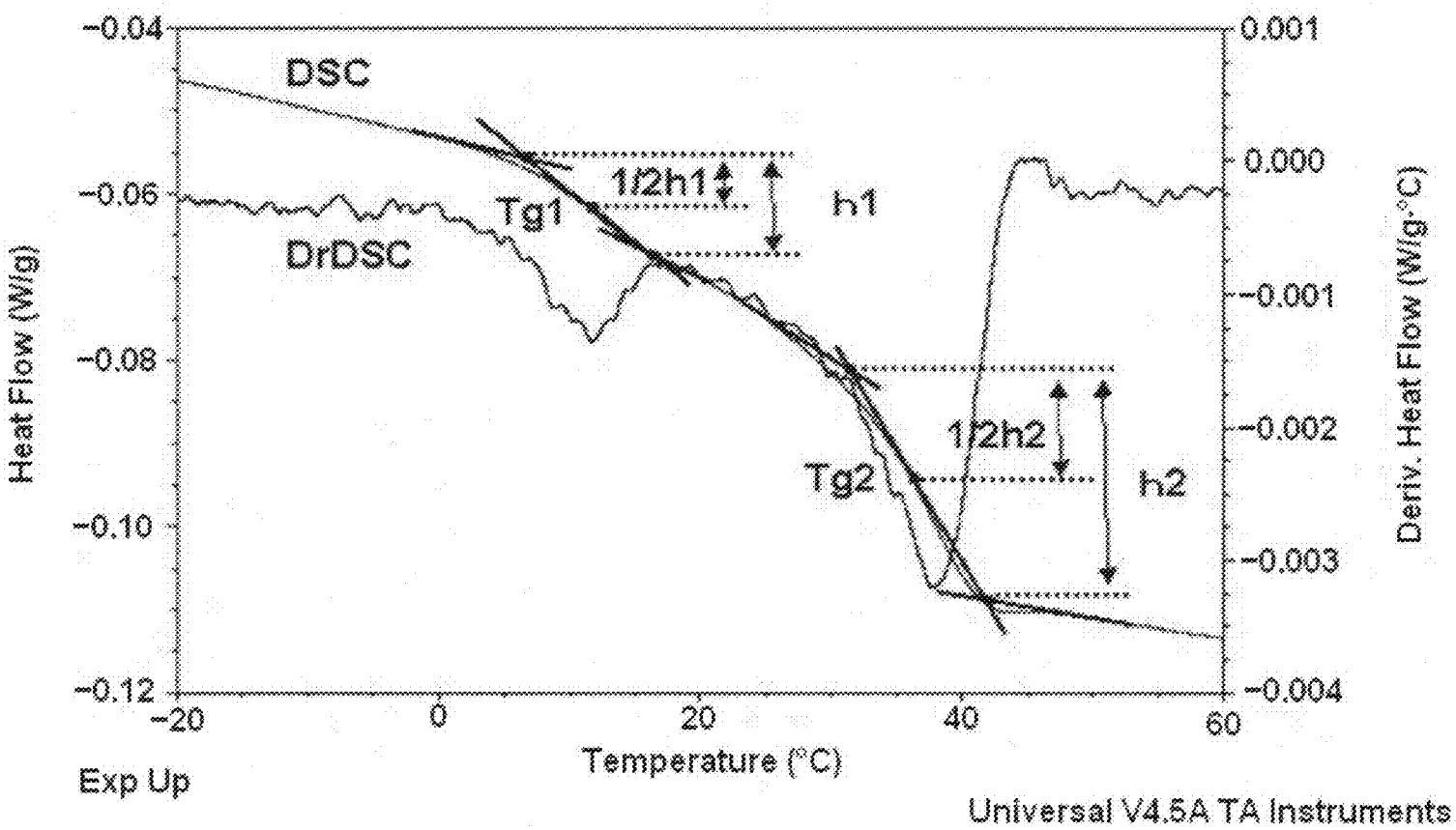
FIG. 1 is a thermogram of a 2nd Heating of a binder resin used in the present invention with Tg1, Tg2, h1, and h2 at that time.

A toner of the present invention includes at least a binder resin and a colorant, and it further includes other components according to necessity.

<Binder Resin>

The binder resin has two glass transition temperatures Tg1 and Tg2 in a differential scanning calorimetry at a heating speed 5° C./min, wherein the glass transition temperature Tg1 is −20° C. to 20° C., and the glass transition temperature Tg2 is 35° C. to 65° C., wherein the binder resin includes a polyester skeleton and a ring-containing skeleton molecule at ends thereof, and wherein the binder resin is obtained by block copolymerization of:

- a polyester skeleton A which includes a structural unit obtained by dehydration condensation a hydroxycarboxylic acid in a repeating structure; and
- a skeleton B which does not include a structural unit obtained by dehydration condensation of a hydroxycarboxylic acid in a repeating structure.

The binder resin is not particularly restricted and may be appropriately selected according to purpose. Nonetheless, a ratio h1/h2, where h1 is a difference in a heat flow between baselines at the glass transition temperature Tg1, and h2 is a difference in a heat flow between baselines at the glass transition temperature Tg2, is preferably less than 1.0.

It is preferable that a binarized image obtained by a binarization process of a phase image of a binder resin observed by a Tapping Mode Atomic Force Microscope at an intermediate boundary value of a maximum value and a minimum value of phase differences in the phase image includes first phase difference images each composed of a region having a larger phase difference than the boundary value and a second phase difference image composed of a region having a smaller phase difference than the boundary value, and the first phase difference images are dispersed in the second phase difference image, and the first phase difference images have an average diameter of less than 100 nm.

To fix a toner to a fixing body by heating, it is necessary for the binder resin to develop an adhesive state at the setting temperature. For this, an amorphous binder resin should at least transfer from a glass state to a rubber state and develop certain fluidity and adhesiveness. However, to fix at a lower temperature, the glass transition temperature of the binder resin should inevitably be lower than an actual use temperature, and blocking that toner particles fuses during storage tends to occur. To the contrary, to prevent blocking in an actual use temperature region, the glass transition temperature should be at least the actual use temperature or greater, and thus a trade-off relationship between low-temperature fixing property and heat-resistant storage stability could not be avoided.

In the present invention, the trade-off relationship between low-temperature fixing property and heat-resistant storage stability may be resolved by a binder resin having a structure that a structure which appears as an image having a large phase difference for developing low-temperature fixing property of the toner (low-Tg unit; first phase difference images) is finely dispersed in a phase which appears as an image having a small phase difference effective for heat-resistant storage stability of the toner (high-Tg unit; second phase difference image).

As the structure of the binder resin which may realize a dispersion state, a structure obtained by block copolymerization of: a polyester skeleton A which includes a polyester skeleton and a ring-containing skeleton molecule at ends thereof, having a structural unit obtained by dehydration condensation of a hydroxycarboxylic acid in a repeating structure; and a skeleton B which does not include a structural unit obtained by dehydration condensation of a hydroxycarboxylic acid in a repeating structure is effective for obtaining a dispersion phase of a structure which appears as a fine and clear image having a large phase difference.

<<Polyester Skeleton A which Includes Structural Unit Obtained by Dehydration Condensation of Hydroxycarboxylic Acid in Repeating Structure>>

The polyester skeleton A including a structural unit obtained by dehydration condensation of a hydroxycarboxylic acid in a repeating structure denotes a skeleton in which a hydroxycarboxylic acid is (co)polymerized (which may also be referred to as "polyhydroxycarboxylic acid skeleton"). Examples of a method for forming the polyester skeleton A include: (1) direct dehydration condensation of a hydroxycarboxylic acid, and (2) ring-opening polymerization of a corresponding cyclic ester. Among these, in view of increasing a molecular weight of the polyhydroxycarboxylic acid being polymerized, a method of ring-opening polymerization of a cyclic ester is particularly preferable.

A monomer as a raw material of the polyester skeleton A is not particularly restricted and may be appropriately selected according to purpose. Nonetheless, in view of transparency and thermal properties of the toner, an aliphatic hydroxycarboxylic acid is preferable, and a hydroxycarboxylic acid having 2 to 6 carbon atoms is more preferable.

Examples of the hydroxycarboxylic acid having 2 to 6 carbon atoms include lactic acid, glycolic acid, 3-hydroxybutyric acid, and 4-hydroxybutyric acid. Among these, lactic acid is particularly preferable in view of appropriate glass transition temperature, transparency of the resin, and compatibility with the colorant.

As the raw material of the polyester skeleton A, it is also possible to use a cyclic ester of a hydroxycarboxylic acid other than the hydroxycarboxylic acid, and in that case, a polyhydroxycarboxylic acid skeleton of the resin obtained by polymerization is a skeleton that a hydroxycarboxylic acid which constitutes the cyclic ester is polymerized. For example, a polyhydroxycarboxylic acid skeleton of a resin obtained using lactide (lactic acid lactide) is a skeleton obtained by polymerization of lactic acid.

The polyester skeleton A which includes a structural unit obtained by dehydration condensation of a hydroxycarboxylic acid in a repeating structure is preferably a polylactic acid skeleton. Polylactic acid is a polymer that lactic acid is bound via ester bonding and is gaining attention as an environmentally friendly biodegradable plastic in recent years. That is, an enzyme which cleaves the ester bond (esterase) is widely distributed in nature, and the polylactic acid is gradually decomposed by such an enzyme in the environment, converted to lactic acid as a monomer, and becomes carbon dioxide and water in the end.

A method for manufacturing the polylactic acid is not particularly restricted and may be appropriately selected according to purpose. Examples thereof include: (1) fermentation of starch of corn, etc. as a raw material to obtain lactic acid, followed by direct dehydration condensation from a lactic acid monomer; and (2) synthesis by ring-opening polymerization of cyclic dimer lactide from lactic acid in the presence of a catalyst. Among these, the ring-opening polymerization method is preferable in view of productivity that the molecular weight may be controlled with an amount of an initiator and that the reaction may be completed in a short period of time.

The initiator is not particularly restricted. As long as it is an alcohol component which is not volatilized by drying at 100° C. and under a reduced pressure of 20 mmHg or less or by polymerization heating at around 200° C., conventionally heretofore known ones may be used regardless of a number of functional groups.

The polyhydroxycarboxylic acid having a structural unit obtained by dehydration condensation of hydroxycarboxylic acid in a repeating structure is not particularly restricted and may be appropriately selected according to purpose. Nonetheless, an optical purity X (%) in terms of a monomer component represented by Equation 1 below is preferably 80% or less. When the optical purity X exceeds 80%, melting at a low temperature is difficult due to high crystallinity, and low-temperature fixing property may decrease.

<Equation 1>

$$X(\%)=|X(L\text{-form})-X(D\text{-form})|$$

where, in Equation 1, X (L-form) represents a proportion of L-form in terms of a lactic acid monomer (%), and X (D-form) represents a proportion of D-form in terms of a lactic acid monomer (%).

Here, a method for measuring the optical purity X (%) is not particularly restricted and may be appropriately selected according to purpose. For example, a polymer or a toner having a polyester skeleton is added to a mixed solvent of pure water, 1N sodium hydrochloride and isopropyl alcohol, which is heated and stirred at 70° C. for hydrolysis. Next, it is filtered to remove solid content in the solution, followed by addition of sulfuric acid for neutralization, and an aqueous solution including L-lactic acid and/or D-lactic acid decomposed from the polyester resin is obtained. The aqueous solution is subjected to a measurement with a high performance liquid chromatography (HPLC) using a chiral ligand-exchange column (SUMICHIRAL OA-5000, manufactured by Sumika Chemical Analysis Service, Ltd.), and a peak area S(L) derived from L-lactic acid and a peak area S(D) derived from D-lactic acid are calculated. From the peak areas, the optical purity X may be obtained as follows.

$$X(L\text{-form})\ \%=100DS(L)/(S(L)+S(D))$$

$$X(D\text{-form})\ \%=100DS(D)/(S(L)+S(D))$$

$$\text{Optical purity } X\ \%=|X(L\text{-form})-X(D\text{-form})|$$

Here, naturally, L-form and D-form used as raw materials are optical isomers, and the optical isomers have physical properties and chemical properties other than optical properties are identical. When they are used for polymerization, their reactivities are equal, and a component ratio of the monomers and a component ratio of the monomers in the polymer are identical.

The optical purity of 80% or less is preferable since solvent solubility and resin transparency improve.

The monomers X(D-form) and X(L-form) that form the polyhydroxycarboxylic acid skeleton have equal proportions to the monomers D-form and L-form used for forming the polyhydroxycarboxylic acid skeleton. Thus, the optical purity X (%) in terms of monomer component of polyhydroxycarboxylic acid skeleton of the binder resin may be controlled by combining appropriate amounts of monomers of L-form and D-form as monomers to obtain a racemic form.

A mass ratio of the polyester skeleton A in the binder resin is not particularly restricted and may be appropriately selected according to purpose. Nonetheless, it is preferably 50% by mass to 75% by mass, and more preferably 60% by mass to 75% by mass.

<<Skeleton B which does not Include Structural Unit Obtained by Dehydration Condensation of Hydroxycarboxylic Acid in Repeating Structure>>

It is important for the skeleton B which does not include a structural unit obtained by dehydration condensation of hydroxycarboxylic acid in a repeating structure to have a glass transition temperature of at least 20° C. or less.

Thereby, the glass transition temperature Tg1 of the binder resin may be reduced to 20° C. or less, enabling a structure that an inner phase having the skeleton B as a main component is dispersed in an outer phase having the polyester skeleton A as a main component. Further, the skeleton B which does not include a structural unit obtained by dehydration condensation of hydroxycarboxylic acid in a repeating structure is formed of a compound having at least 2 hydroxyl groups, and for example, the binder resin may be obtained by ring-opening polymerization of lactide with the compound as an initiator. To form the skeleton B, using the compound having 2 or more hydroxyl groups is effective in improving compatibility with the colorant, and at the same time, by disposing the high-Tg unit derived from the polyester skeleton A at both ends thereof, it is possible to build a skeleton of the binder resin which allows the low-Tg unit derived from skeleton B as described above.

The skeleton B is not particularly restricted and may be appropriately selected according to purpose as long as it does not include a structural unit obtained by dehydration condensation of hydroxycarboxylic acid in a repeating structure. Examples thereof include polyether, polycarbonate, polyester, a vinyl resin having a hydroxyl group, and a silicone resin having a hydroxyl group at ends thereof. Among these, a polyester skeleton is particularly preferable in view of compatibility with the colorant.

The polyester skeleton which constitutes the skeleton B may be obtained by ring-opening addition polymerization of polyesterification product of at least one type of polyol represented by General Formula (1) below and at least one type of polycarboxylic acid represented by General Formula (2) below.

$$A\text{-}(OH)_m \qquad \text{General Formula (1)}$$

Here, in General Formula (1), A represents an alkyl group having 1 to 20 carbon atoms, an alkylene group having 1 to 20 carbon atoms, an aromatic group or a heterocyclic aromatic group which may have a substituent, and m represents an integer of 2 to 4.

$$B\text{—}(COOH)_n \qquad \text{General Formula (2)}$$

Here, in General Formula (2), B represents an alkyl group having 1 to 20 carbon atoms, an alkylene group having 1 to 20 carbon atoms, or an aromatic group or a heterocyclic aromatic group which may have a substituent, and n represents an integer of 2 to 4.

Examples of the polyol represented by General Formula (1) include ethylene glycol, diethylene glycol, triethylene glycol, 1,2-propylene glycol, 1,3-propyleneglycol, 1,4-butanediol, neopentylglycol, 1,4-butenediol, 1,5-pentanediol, 3-methyl-1,5-pentanediol, 1,6-hexanediol, 1,4-cyclohexanedimethanol, dipropylene glycol, polyethylene glycol, polypropylene glycol, polytetramethyleneglycol, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, bisphenol A, ethylene oxide adduct of bisphenol A, propylene oxide adduct of bisphenol A, hydrogenated bisphenol A, ethylene oxide adduct of hydrogenated bisphenol A, and propylene oxide adduct of hydrogenated bisphenol A. These may be used alone or in combination of two or more.

Examples of the polycarboxylic acid represented by General Formula (2) include maleic acid, fumaric acid, citraconic acid, itaconic acid, glutaconic acid, phthalic acid, and isophthalic acid, terephthalic acid, succinic acid, adipic acid, sebacic acid, azelaic acid, malonic acid, n-dodecenylsuccinic acid, isooctylsuccinic acid, isododecenylsuccinic acid, n-dodecylsuccinic acid, isododecylsuccinic acid, n-octenylsuccinic acid, n-octylsuccinic acid, isooctenylsuccinic acid, isooctylsuccinic acid, 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexane tricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, EMPOL trimer acid, cyclohexanedicarboxylic acid, cyclohexenedicarboxylic acid, butanetetracarboxylic acid, diphenyl sulfone tetracarboxylic acid, and trimellitic acid. These may be used alone or in combination of two or more.

It is preferable that the polyester skeleton which constitutes the skeleton B includes 1.5% by mole or greater of a polycarboxylic acid having 3 or more valences as an acid component. As the polycarboxylic acid having 3 or more valences, trimellitic acid is preferable. Introduction of the polycarboxylic acid having 3 or more valences may impart appropriate branched or crosslinking structure, and the branched structure may reduce a substantive molecular length. Thereby, it is possible to control to reduce an average diameter of skeleton B dispersed in the inner phase, and it is possible to control to reduce an average diameter in the dispersion phase of a structure which appears as an image having a large phase difference (first phase difference images) observed by Tapping Mode Atomic Force Microscope (AFM). A content of the polycarboxylic acid having 3 or more valences of less than 1.5% by mole results in insufficient branching. This increases the average diameter of the first phase difference images more than necessary, and the average diameter in a dispersion phase of the structure which appears as an image having a large phase difference tends to be large, which may adversely affect heat-resistant storage stability. Also, an upper limit of the content of the polycarboxylic acid having 3 or more valences is preferably 3% by mole or less. When the content exceeds 3% by mole, complexity of the branching or crosslinking structure increases, thereby the molecular weight of the resin may increase, or solvent solubility may degrade.

The skeleton B preferably has a certain number-average molecular weight and a mass ratio, and the mass ratio of the skeleton B in the binder resin is not particularly restricted and may be appropriately selected according to purpose. Nonetheless, it is preferably 25% by mass to 50% by mass, and more preferably 25% by mass to 40% by mass.

The number-average molecular weight Mn (B) of the skeleton B is not particularly restricted and may be appropriately selected according to purpose. Nonetheless, it is preferably 3,000 to 5,000, and more preferably 3,000 to 4,000.

The number-average molecular weight may be measured, for example, by GPC (gel permeation chromatography).

When the mass ratio is less than 25% or the number-average molecular weight Mn of the skeleton B is less than 3,000, the average diameter of the image having a large phase difference (first phase difference images) is too small, it becomes hard to confirm two glass transition temperatures, and desired low-temperature fixing property may not be obtained. On the other hand, when the mass ratio exceeds 50% by mass or the number-average molecular weight of the skeleton B exceeds 5,000, the average diameter of the image having a large phase difference (first phase difference images) is too large, and blocking within the toner involving long-term storage is likely to occur.

<<Ring-Containing Skeleton Molecule>>

The ring-containing skeleton molecule is not particularly restricted as long as it includes a cyclic structure and is monofunctional, and it may be appropriately selected according to purpose.

The ring-containing skeleton molecule is defined as a compound prior to a reaction with the polyester skeleton A, or a connected component described hereinafter. Also, the ring-containing skeleton molecule being monofunctional means that it includes only one functional group having reactivity with the polyester skeleton A, or connected component described hereinafter.

Examples of the cyclic structure include a monocyclic aliphatic cyclic structure, a monocyclic aromatic cyclic structure, a monocyclic heterocyclic structure, and a polycyclic structure including 2 or more cyclic structures. These cyclic structures may be substituted by a substituent, and examples of the substituent include a hydroxyl group, an amino group, an alkyl group, a halogen atom, and a cyano group. Among these, the polycyclic structure and the polycyclic structure having a substituent are particularly preferable.

Examples of the monocyclic aliphatic cyclic structure include cyclopentane and cyclohexane. Examples of the monocyclic aromatic cyclic structure include benzene, toluene, and xylene. Examples of the monocyclic heterocyclic structure include pyridine, furan, and thiophen.

Examples of the polycyclic structure include: a polycyclic aromatic compound such as naphthalene, and anthracene; a polycyclic aromatic heterocyclic compound such as quinoline, benzofuran, and acridine; and dehydroabietic acid skeleton, and steroid skeleton. Among these, from the viewpoint of being derived from a natural product, cholesterol as one type of the steroid skeleton is particularly preferable.

The binder resin has the ring-containing skeleton molecule at ends thereof.

A method for introducing the ring-containing skeleton molecule to the end of the binder resin is not particularly restricted and may be appropriately selected according to purpose. For example, a method for synthesizing a binder resin described hereinafter may be used.

Whether or not the binder resin has a ring-containing skeleton molecule at ends thereof may be confirmed by, for example, presence or absence of signal of a proton peak bound to an aromatic ring by measuring nuclear magnetic resonance (NMR) of the binder resin.

In the present invention, the binder resin is synthesized by block copolymerization of: polyester skeleton A which includes a structural unit obtained by dehydration condensation of the hydroxycarboxylic acid in a repeating structure; and skeleton B which does not include a structural unit obtained by dehydration condensation of the hydroxycarboxylic acid in a repeating structure.

Examples of the method for synthesizing the binder resin include: (1) a precursor which will be the polyester skeleton A is synthesized, using a ring-containing skeleton molecule as an initiator, followed by reacting the precursor with a compound for forming the skeleton B which does not include a structural unit obtained by dehydration condensation of a hydroxycarboxylic acid in a repeating structure; and (2) using a compound for forming the skeleton B which does not include a structural unit obtained by dehydration condensation of hydroxycarboxylic acid in a repeating structure as an initiator, a (co)polymer of hydroxycarboxylic acid obtained by ring-opening polymerization of lactide or obtained via a connected component described hereinafter is reacted with the compound for forming the skeleton B, followed by further reacting it with a ring-containing skeleton molecule.

—Connected Component—

Examples of the connected component include an isocyanate compound, a diglycidyl ether compound, an acid anhydride compound, and aliphatic carboxylic acid or acid chloride thereof. These may be used alone or in combination of two or more.

Examples of the isocyanate compound include tolylene diisocyanate, tolidine diisocyanate, xylylene diisocyanate, diphenylmethane diisocyanate, 1,5-naphthylene diisocyanate, isophorone diisocyanate, lysine diisocyanate, hexamethylene diisocyanate, and methylene-bis-cyclohexyl diisocyanate.

Examples of the diglycidyl ether compound include resorcinol diglycidyl ether, neopentylglycol diglycidyl ether, hexanediol diglycidyl ether, hydrogenated bisphenol A diglycidyl ether, diglycidyl terephthalic acid, diglycidyl and isophthalic acid, ethylene glycol diglycidyl ether, diethylene glycol diglycidyl ether, polyethylene glycol diglycidyl ether, and polypropylene glycol diglycidyl ether.

Examples of the acid anhydride compound include naphthalene tetracarboxylic anhydride, dioxotetrahydrofuranylmethylcyclohexene dicarboxylic anhydride, pyromellitic anhydride, oxydiphthalic anhydride, biphenyltetracarboxylic anhydride, benzophenonetetracarboxylic anhydride, diphenylsulfonetetracarboxylic anhydride, tetrafluoroisopropylidenediphthalic anhydride, terphenyltetracarboxylic anhydride, cyclobutane tetracarboxylic anhydride, and carboxymethylcyclopentane tricarboxylic anhydride.

Examples of the aliphatic carboxylic acid or the acid chloride thereof include oxalic acid, malonic acid, succinic acid, glutaric acid, adipic acid, pimelic acid, suberic acid, azelaic acid, sebacic acid, and cyclohexanedicarboxylic acid, and acid chlorides thereof.

The connected component being the isocyanate compound is preferable since the isocyanate group forms a urethane bond by reacting with a hydroxyl group of the polyhydroxycarboxylic acid skeleton. Among the isocyanate compound, diisocyanate is more preferable since it has high reactivity and is easy to handle; aromatic diisocyanate is particularly preferable since it has high reactivity and is highly effective in preventing the glass transition temperature (Tg) from decreasing; and isophorone diisocyanate (abbreviation: IPDI) is the most preferable in view of reactivity and safety.

In the present invention, for promoting various polymerization reactions, an esterification catalyst or an urethanization catalyst of an amine compound, a tin compound, a titanium compound, etc. may be used. However, the urethanization catalyst is preferably not used at all or used in a minimal amount since it may also act as a decomposition catalyst in the resin.

Here, during the resin polymerization process and/or after polymerization, various additives such as heretofore known heat stabilizer, antioxidant, cerium oxide, flame retardant, non-reactive hydrolysis inhibitor, lightfastness improving agent, wax, lubricant, charge controlling agent, organic plasticizer, other biodegradable thermoplastic resins, colorant, and flatting agent may be appropriately added according to necessity.

The number-average molecular weight Mn of the binder resin is not particularly restricted and may be appropriately selected according to purpose. Nonetheless, it is preferably 20,000 or less, and more preferably 8,000 to 15,000. When the number-average molecular weight exceeds 20,000, fixability may be impaired, and at the same time, solubility to a solvent may decrease.

A weight-average molecular weight of the binder resin is not particularly restricted and may be appropriately selected according to purpose. Nonetheless, it is preferably 8,000 to 40,000.

The number-average molecular weight and the weight-average molecular weight may be measured, for example, by GPC (gel permeation chromatography).

<<Glass Transition Temperature of Binder Resin>>

The glass transition temperature of the binder resin may be obtained from an endothermic chart of a differential scanning calorimeter (DSC). Examples of the differential scanning calorimeter include Q2000, manufactured by TA Instruments.

The glass transition temperature of the binder resin may be obtained by subjecting 5 mg to 10 mg of the binder resin filled in a sealed pan made of aluminum to the following measurement flow.

1st Heating: 30° C. to 220° C., 5° C./min; maintaining for 1 minute after reaching to 220° C.

Cooling: quenching to −60° C. without temperature control; maintaining for 1 minute after reaching to −60° C.

2nd Heating: −60° C. to 180° C., 5° C./min

The glass transition temperature of the binder resin is defined as a value as a glass transition temperature read from the thermogram in the 2nd Heating based on a midpoint method defined by ASTM D3418/82. At this time, a glass transition temperature on a low-temperature side and a glass transition temperature on a high-temperature side are defined as Tg1 and Tg2, respectively. Here, the glass transition temperatures are preferably identified by determination of inflection points obtained by a first-order derivative DrDSC chart drawn together.

In a thermogram of the 2nd Heating, a difference of heat flow between baselines at the glass transition temperature Tg1 and a difference of heat flow between baselines at the glass transition temperature Tg2 are defined as h1 and h2, respectively. These differences h1 and h2 may be obtained from differences between the onset point on the low-temperature side and the endset point on a high-temperature side at the respective glass transition temperatures.

The onset point and the endset point may be obtained, for example, by a method conforming to JIS K 7121, ASTM 3418, etc.

Here, a typical thermogram of a binder resin in the 2nd Heating and the definitions of Tg1, Tg2, h1, and h2 accompanied therewith in the present invention are illustrated in FIG. 1.

—Glass Transition Temperature Tg1 and Tg2—

The glass transition temperature Tg1 on the low-temperature side of the binder resin is −20° C. to 20° C. When the Tg1 is less than −20° C., toner blocking property during storage may degrade. When it exceeds 20° C., low-temperature fixing property may be impaired since a difference of thermal properties from the high-Tg portion protecting on an outside is reduced.

The glass transition temperature Tg2 on the high-temperature side of the binder resin is 35° C. to 65° C., and it is preferably 45° C. to 60° C. When the Tg2 is less than 35° C., protection against low-Tg region having superior low-temperature fixing property does not act, and toner blocking may occur. When it exceeds 65° C., bleeding of the encapsulated low-Tg unit during fixing is inhibited, and fixability may largely degrade.

—Ratio of Differences of Baselines h1 and h2, h1/h2—

Regarding the binder resin, a ratio, h1/h2, of a difference h1 between the baselines at the glass transition temperature Tg1 to a difference h2 between the baselines at the glass transition temperature Tg2 is not particularly restricted and may be appropriately selected according to purpose. Nonetheless, it is preferably less than 1.0. In the structure that the low-Tg unit is dispersed, Tg1 and Tg2 do not necessarily correspond to the glass transition temperatures of the skeleton B and the polyester skeleton A, respectively. Internal morphology of the binder resin is determined by partially miscible portion or micro phase separation structure. Two (2) glass transition temperatures are observed between the glass transition temperatures of the skeleton B and the polyester skeleton A, respectively. Also, the ratio h1/h2 of the baselines then is not necessarily determined by the mass ratio of the charged components for this reason. The ratio h1/h2 of the baselines represents an actual ratio of the low-Tg unit and the high-Tg unit in the finally produced binder resin, and the ratio h1/h2 is preferably less than 1.0. When the ratio h1/h2 is 1.0 or greater, an increased proportion of the low-Tg unit degrades blocking property of the toner. In an extreme example, reversal of the phase separation structure that the high-Tg unit is dispersed in the phase of the low-Tg unit may occur.

<<Phase Image by Tapping Mode of Atomic Force Microscope (AFM)>>

In the toner, the binder resin is characterized in having a structure controlled such that a unit having Tg1 with superior low-temperature fixing property is finely dispersed by a unit having Tg2 with superior storage stability, and the dispersion state may be confirmed with a phase difference image by Tapping Mode Atomic Force Microscope (AFM).

Tapping Mode in Atomic Force Microscope is a method described in Surface Science Letters, 290, 668 (1993), and as explained in Polymer, 35, 5778 (1994), Macromolecules, 28, 6773 (1995), etc., the Tapping Mode measures a shape of a surface sample by vibrating a cantilever, for example. At this time, due to viscoelasticity of the sample surface, phase difference occurs between a drive as a source of the vibration of the cantilever and an actual vibration. A phase image is mapping of this phase difference. A large phase delay is observed at a soft portion, and a small phase delay is observed at a hard portion.

A unit in the binder resin having a low Tg is softer, i.e., having an increased phase difference. A unit having a high Tg is hard, and an image having a small phase difference (second phase difference image) is observed. At this time, a structure that an image having a low phase difference as a hard portion is an outer phase and that an image having a high phase difference as a soft portion (first phase difference images) is an inner phase and finely dispersed is preferable. In other words, it is preferable that a binarized image that a phase image of a binder resin observed by Tapping Mode Atomic Force Microscope is subjected to a binarization process at a boundary value in the middle of a maximum value and a minimum value of a phase difference in the phase image includes a first phase difference images each including a portion having a phase difference larger than the boundary value and a second phase difference image including a portion having a phase difference smaller than the boundary value and that the first phase difference images are dispersed in the second phase difference image.

More specifically, the phase image is photographed to have a contrast of a dark color at a portion having a small phase difference and a pale color at a portion having a large phase difference, and thereafter, a binary image (black-and-white image) is obtained by a binarization process with an intermediate value between the maximum value and the minimum value of the phase difference as a boundary. It is preferable that first phase difference images as white portions are dispersed in a second phase difference image as a black portion.

A sample for obtaining the phase image may be observed with, for example, a slice obtained by cutting a block of a binder resin using an ultramicrotome (ULTRACUT UCT, manufactured by Leica) under the following conditions.

Cutting thickness: 60 nm

Cutting speed: 0.4 mm/sec

Diamond knife (ULTRA SONIC 35°) used

A typical apparatus for obtaining the AFM phase image, for example, an observation may be carried out in MFP-3D, manufactured by Asylum Technology Co., Ltd., using OMCL-AC240TS-C3 as a cantilever under the following measurement conditions.

Target amplitude: 0.5V

Target percent: −5%

Amplitude setpoint: 315 mV

Scan rate: 1 Hz

Scan points: 256D256

Scan angle: 0°

—Average Diameter of First Phase Difference Images—

An average diameter of the first phase difference images (i.e., soft, low-Tg unit) is defined as an average value of 30 maximum Feret's diameter values of the first phase difference images in the phase image selected in order from the larger diameter. Here, an image having a small diameter that is clearly determined as an image noise or is difficult to determine whether it is an image noise or a phase difference image is excluded from the calculation of the average diameter. Specifically, in the observed phase image, first phase difference images having an area of less than one-hundredth of first phase difference images having the maximum diameter is not used for the calculation of the average diameter.

The maximum Feret's diameter is a maximum distance between two parallel lines sandwiching a phase difference image.

As a specific method for measuring the average diameter, it is carried out by creating a binarized image of the obtained phase image by Tapping Mode AFM.

As described above, a phase image is photographed to have a contrast of a dark color at a portion having a small phase difference and a pale color at a portion having a large phase difference, and thereafter, a binary image is obtained by a binarization process with an intermediate value between the maximum value and the minimum value of the phase difference as a boundary.

An average diameter of the first phase difference images (i.e. soft, low-Tg unit) is not particularly restricted and may be appropriately selected according to purpose. Nonetheless, it is preferably less than 100 nm.

The average diameter is preferably less than 100 nm, more preferably 20 nm or greater, and further more preferably 30 nm to 70 nm. When the average diameter is 100 nm or greater, toner blocking is likely to occur during storage. When it is less than 20 nm, low-temperature fixing property may degrade.

Figure 2:
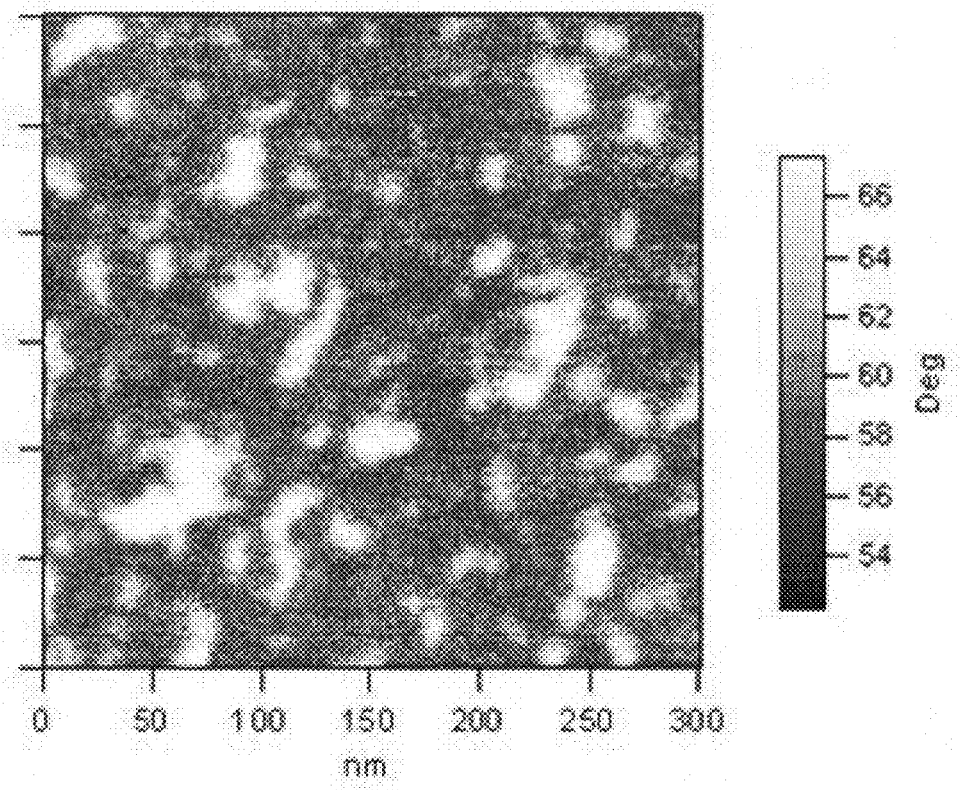
FIG. 2 is a phase image of a binder resin by a Tapping Mode AFM used in the present invention.
Figure 3:
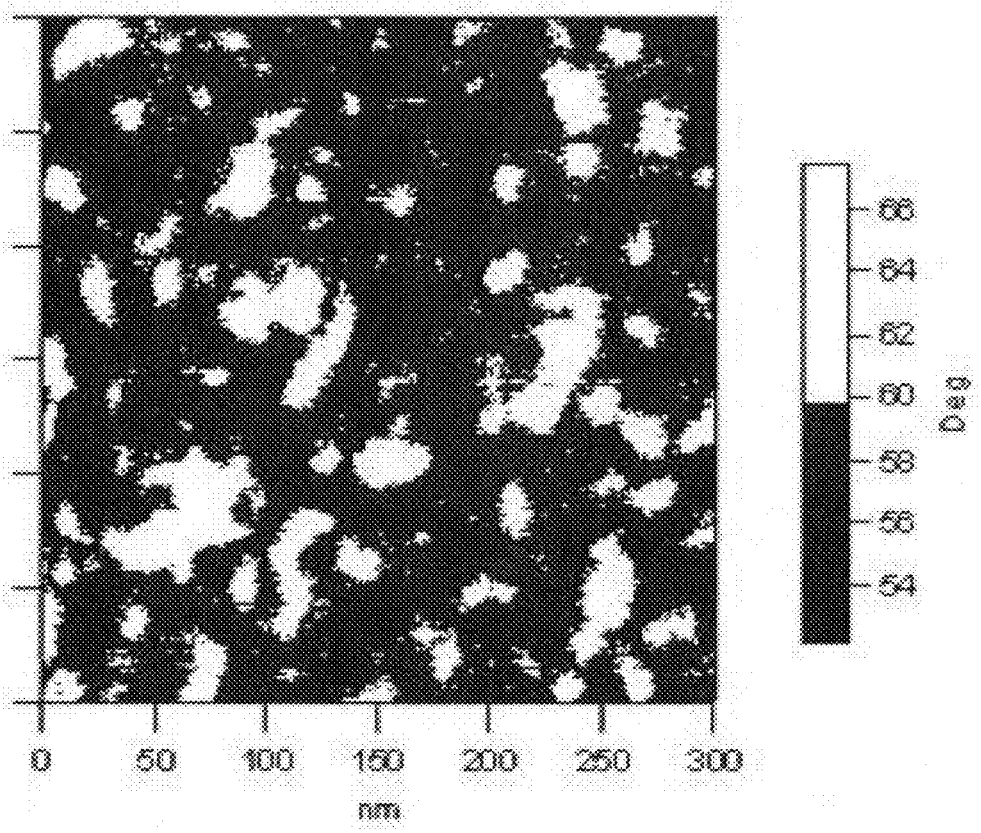
FIG. 3 is a binarized image obtained by a binarization process with an intermediate value of a maximum value of a phase difference and a minimum value of a phase difference in the phase image of FIG. 2 as a boundary.

Here, FIG. 2 illustrates a phase image of a typical binder resin in the present invention. In FIG. 2, a bright region corresponds to an image having a large phase difference (first phase difference images), and a dark region corresponds to an image having a small phase difference (second phase difference image). Also, FIG. 3 illustrates a binarized image obtained by a binarization process with an intermediate value between the maximum value and the minimum value of the phase difference in the phase image of FIG. 2 as a boundary.

<Colorant>

The colorant is not particularly restricted and may be appropriately selected from heretofore known dyes and pigments according to purpose. Examples thereof include carbon black, nigrosine dye, iron black, naphthol yellow S, Hansa Yellow (10G, 5G, G), cadmium yellow, yellow iron oxide, yellow ocher, chrome yellow, titanium yellow, polyazo yellow, Oil Yellow, Hansa Yellow (GR, A, RN, R), Pigment Yellow L, Benzidine Yellow (G, GR), Permanent Yellow (NCG) (NCG), Vulcan Fast Yellow (5G, R), tartrazine lake, quinoline yellow lake, Anthrazane Yellow BGL, isoindolinone yellow, colcothar, red lead, lead vermilion, cadmium red, Cadmium Mercury Red, antimony vermilion, Permanent Red 4R, Para Red, fiser red, para-chloro-ortho-nitro aniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubin B, Brilliant Scarlet G, Lithol Rubin GX, Permanent Red F5R, Brilliant Carmine 6B, Pigment Scarlet 3B, Bordeaux 5B, Toluidine Maroon, Permanent Bordeaux F2K, Hello Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS, BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, phthalocyanine green, anthraquinone green, titanium oxide, zinc oxide, lithopone. These may be used alone or in combination of two or more.

A content of the colorant in the toner is not particularly restricted and may be appropriately selected according to purpose. Nonetheless, it is preferably 1% by mass to 15% by mass, and more preferably 3% by mass to 10% by mass. When the content is less than 1% by mass, degradation of coloring strength of the toner may be observed. When it exceeds 15% by mass, poor dispersion of the pigment in the toner may occur, inviting decrease in coloring strength and electrical characteristics of the toner.

The colorant may be formed into a composite with a resin and used as a masterbatch. The resin is not particularly restricted and may be appropriately selected from heretofore known ones according to proposes. Examples thereof include polyester, a polymer of styrene or substituent thereof a styrene copolymer, polymethyl methacrylate, polybutyl methacrylate, polyvinyl chloride, polyvinyl acetate, polyethylene, polypropylene, an epoxy resin, an epoxy polyol resin, polyurethane, polyamide, polyvinyl butyral, polyacrylic acid, rosin, modified rosin, a terpene resin, an aliphatic hydrocarbon resin, an aliphatic hydrocarbon resin, an aromatic petroleum resin, chlorinated paraffin, and paraffin wax. These may be used alone or in combination of two or more.

Examples of the polymer of styrene or substituent thereof include a polyester resin, polystyrene, poly-p-chlorostyrene, and polyvinyltoluene. Examples of the styrene copolymer include a styrene-p-chlorostyrene copolymer, a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-methyl methacrylate copolymer, a styrene-ethyl methacrylate copolymer, a styrene-butyl methacrylate copolymer, a styrene-α-methyl chloromethacrylate copolymer, a styrene-acrylonitrile copolymer, a styrene-vinyl methyl ketone copolymer, a styrene-butadiene copolymer, a styrene-isoprene copolymer, a styrene-acrylonitrile-indene copolymer, a styrene-maleic acid copolymer, and a styrene-maleate copolymer.

The masterbatch may be obtained by mixing and kneading the resin for a masterbatch and the colorant with an application of high shear force. Here, in order to enhance an interaction between the colorant and the resin, an organic solvent may be preferably added. Also, a so-called flushing method is favorable since a wet cake of the colorant may be used as it is, without necessity of drying. The flushing method is a method of mixing and kneading an aqueous paste of the colorant including water with a resin and an organic medium to remove the water and the organic medium by transferring the colorant to the resin. For the mixing or kneading, for example, a high shear dispersing apparatus such as three-roll mill may be favorably used.

<Other Component>

The other component is not particularly restricted and may be appropriately selected according to purpose. Examples thereof include a releasing agent, a charge controlling agent, inorganic fine particles, a fluidity improving agent, a cleanability improving agent, and a magnetic material.

—Releasing Agent—

The releasing agent is not particularly restricted and may be appropriately selected according to purpose. Nonetheless a releasing agent having a low melting point of 50° C. to 120° C. is preferable. The releasing agent having a low melting point works effectively as a releasing agent between a fixing roller and toner interface by being dispersed with the resin, and thereby, favorable hot offset property may be obtained even if a releasing agent such as oil is not applied on the fixing roller (oilless).

As the releasing agent, for example, waxes are favorable.

Examples of the waxes include natural waxes, including vegetable waxes such as carnauba wax, cotton wax, Japan wax, and rice wax; animal waxes such as bees wax, and lanolin; mineral waxes such as ozokerite, and ceresin; and petroleum waxes such as paraffin, microcrystalline wax, and petrolatum. Also, in addition to these natural waxes, the examples further include: synthetic hydrocarbon waxes such as Fischer-Tropsch wax, and polyethylene wax; and synthetic waxes such as esters, ketones, and ethers. Further, it is also possible to use: a fatty acid amide such as 12-hydroxyl stearic amide, stearic amide, phthalic anhydride imide, and chlorinated hydrocarbons; a homopolymer or a copolymer of a polyacrylate such as poly-n-stearyl methacrylate, and poly-n-lauryl methacrylate (e.g. a copolymer of n-stearyl acrylate-ethyl methacrylate, etc.), which is a low-molecular-weight crystalline polymeric resin; and a crystalline polymer having a long alkyl group in a side chain. These may be used alone or in combination of two or more.

A melting point the releasing agent is not particularly restricted and may be appropriately selected according to purpose. Nonetheless, it is preferably 50° C. to 120° C., and more preferably 60° C. to 90° C. When the melting point is less than 50° C., the wax may adversely affect heat-resistant storage stability. When it exceeds 120° C., cold offset may be likely to occur during fixing at a low temperature.

A melt viscosity of the releasing agent is not particularly restricted and may be appropriately selected according to purpose. Nonetheless, it is preferably 5 cps to 1,000 cps, and more preferably 10 cps to 100 cps as a measurement value at a temperature higher by 20° C. than the melting point of the releasing agent. When the melt viscosity is less than 5 cps, releasing property may decrease. When it exceeds 1,000 cps, improvement of hot-offset resistance and low-temperature fixing property may not be obtained.

A content of the releasing agent in the toner is not particularly restricted and may be appropriately selected according to purpose. Nonetheless, it is preferably 40% by mass or less, and more preferably 3% by mass to 30% by mass. When the content exceeds 40% by mass, fluidity of the toner may degrade.

—Charge Controlling Agent—

The charge controlling agent is not particularly restricted and may be appropriately selected from heretofore known agents according to purpose. Examples thereof include nigrosine dyes, triphenylmethane dyes, chromium-containing metal complex dyes, molybdic acid chelate pigments, rhodamine dyes, alkoxy amines, quaternary ammonium salt (including fluorine-modified quaternary ammonium salts), alkyl amides, elemental phosphorus or phosphorus compound, elemental tungsten or tungsten compounds, fluorine surfactants, metal salts of salicylic acid, and metal salts of salicylic acid derivatives. These may be used alone or in combination of two or more.

Commercially available products may be used as the charge controlling agent, and examples of the commercially available products include: BONTRON 03 of a nigrosine dye, BONTRON P-51 of a quaternary ammonium salt, BONTRON S-34 of a metal-containing azo dye, E-82 of an oxynaphthoic acid metal complex, E-84 of a salicylic acid metal complex, E-89 of a phenol condensate (all manufactured by Orient Chemical Industries Co., Ltd.); TP-302, TP-415 of quaternary ammonium salt molybdenum complexes (all manufactured by Hodogaya Chemical Co., Ltd.); Copy charge PSY VP2038 of a quaternary ammonium salt, Copy Blue PR of a triphenylmethane derivative, Copy charge NEG VP2036 and Copy charge NX VP434 of quaternary ammonium salts (all manufactured by Hoechst); LRA-901, and LR-147 of a boron complex (manufactured by Carlit Japan Co., Ltd.); copper phthalocyanine, perylene, quinacridone, azo pigments, and other polymeric compounds including a functional group such as sulfonic acid group, carboxyl group and quaternary ammonium salt.

A content of the charge controlling agent in the toner varies depending on types of the resin, presence or absence of additives, dispersion methods, etc. and cannot be unequivocally defined, but for example, it is preferably 0.1 parts by mass to 10 parts by mass, and more preferably 0.2 parts by mass to 5 parts by mass with respect to 100 parts by mass of the binder resin. When the content is less than 0.1 parts by mass, charge controlling property may not be obtained. When it exceeds 10 parts by mass, charging property of the toner is too large, weakening an effect of the main charge controlling agent. This results in increase of electrostatic attractive force with a developing roller, which may invite decrease in fluidity of a developer and decrease in image density.

—Inorganic Fine Particles—

The inorganic fine particles may be used as an external additive for imparting fluidity, developing property, charging property, etc. to the toner particles.

The inorganic fine particles are not particularly restricted and may be appropriately selected from heretofore known particles according to purpose. Examples thereof include silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, colcothar, antimony trioxide, magnesium oxide, zirconium oxide, barium sulfate, barium carbonate, calcium carbonate, silicon carbide, silicon nitride. These may be used alone or in combination of two or more.

A primary particle diameter of the inorganic fine particles is not particularly restricted and may be appropriately selected according to purpose. Nonetheless, it is preferably 5 nm to 2 μm, and more preferably 5 nm to 500 nm.

A content of the inorganic fine particles in the toner is not particularly restricted and may be appropriately selected according to purpose. Nonetheless, it is preferably 0.01% by mass to 5.0% by mass, and more preferably 0.01% by mass to 2.0% by mass.

—Fluidity Improving Agent—

The fluidity improving agent means an agent which increases hydrophobicity by a surface treatment of the toner and prevents degradation of fluidity properties and charge properties of the toner even under high humidity. Examples thereof include a silane coupling agent, a silylating agent, a silane coupling agent having a fluorinated alkyl group, an organic titanate coupling agent, an aluminum-based coupling agent, a silicone oil, and a modified silicone oil. It is particularly preferable to use the silica and the titanium oxide as hydrophobicity silica and hydrophobicity titanium oxide by surface treatment with such a fluidity improving agent.

—Cleanability Improving Agent—

The cleanability improving agent is added to the toner in order to remove a developer remaining on a photoconductor or a primary transfer medium after transfer. Examples thereof include: a metal salt of a fatty acid such as stearic acid, including zinc stearate and calcium stearate; and polymer particles obtained by soap-free emulsion polymerization of methyl methacrylate particles or polystyrene particles. A volume-average particle diameter of the polymeric particles is not particularly restricted and may be appropriately selected according to purpose. Nonetheless, it is preferably 0.01 μm to 1 μm.

—Magnetic Material—

The magnetic material is not particularly restricted and may be appropriately selected from heretofore known materials according to purpose. Examples thereof include iron powder, magnetite, and ferrite. Among these, white ones are preferable in terms of color tone.

<Method for Manufacturing Toner>

Hereinafter, a method for manufacturing a toner used in the present invention is explained. Here, a preferable method for manufacturing is described, but it is not limited thereto.

As the method for manufacturing a toner, it is preferable that an emulsion or dispersion is prepared by dissolving or dispersing a solution or dispersion of toner materials in an aqueous medium, followed by granulation of the toner, and it preferably includes the following steps (1) to (6).

(1) Preparation of Solution or Dispersion of Toner Material

A solution or dispersion of the toner material may be obtained by dissolving or dispersing the toner material in an organic solvent.

The toner material is not particularly restricted as long as it may form a toner, and it may be appropriately selected according to purpose. For example, it includes at least the binder resin, and it further includes the other components such as releasing agent, colorant, and charge controlling agent according to necessity.

The solution or dispersion of the toner material may be obtained by dissolving or dispersing the toner material in the organic solvent. Here, the organic solvent is removed during granulation or after granulation of the toner.

The organic solvent is not particularly restricted as long as it is a solvent which may dissolve or disperse the toner material, and it may be appropriately selected according to purpose. For example, in view of easy removal, ones having a volatility with a boiling point of less than 150° C., and examples thereof include toluene, xylene, benzene, carbon tetrachloride, methylene chloride, 1,2-dichloroethane, 1,1,2-trichloroethane, trichlorethylene, chloroform, monochlorobenzene, dichloroethylidene, methyl acetate, ethyl acetate, methyl ethyl ketone, and methyl isobutyl ketone. These may be used alone or in combination of two or more. Among these, ester solvents are preferable, and ethyl acetate is particularly preferable.

An amount of the organic solvent used is not particularly restricted and may be appropriately selected according to purpose. Nonetheless, it is preferably 40 parts by mass to 300 parts by mass, more preferably 60 parts by mass to 140 parts by mass, and further more preferably 80 parts by mass to 120 parts by mass, with respect to 100 parts by mass of the toner material.

(2) Preparation of Aqueous Medium

The aqueous medium is not particularly restricted and may be appropriately selected from heretofore known media. Examples thereof include water, solvents miscible with the water, and mixtures thereof. Among these, water is particularly preferable.

the solvent miscible with water is not particularly restricted as long as it is miscible with the water, and examples thereof include alcohols, dimethylformamide, tetrahydrofuran, cellosolves, and lower ketones.

Examples of the alcohols include methanol, isopropanol, and ethylene glycol. Examples of the lower ketones include acetone, and methyl ethyl ketone. These may be used alone or in combination of two or more.

Preparation of the aqueous medium may be carried out by dispersing resin particles in the aqueous medium. An added amount of the resin particles in the aqueous medium is not particularly restricted and may be appropriately selected according to purpose. Nonetheless, it is preferably 0.5% by mass to 10% by mass.

The resin particles are not particularly restricted as long as they are resins which may form an aqueous dispersion in the aqueous medium, and they may be appropriately selected from heretofore known resins according to purpose. The resin may be a thermoplastic resin or a thermosetting resin, and examples thereof include a vinyl resin, a polyurethane resin, an epoxy resin, a polyester resin, a polyamide resin, a polyimide resin, a silicon resin, a phenol resin, a melamine resin, an urea resin, an aniline resin, an ionomer resin, and a polycarbonate resin.

These may be used alone or in combination of two or more. Among these, the resin particles are preferably formed with at least one selected from the group consisting of a vinyl resin, a polyurethane resin, an epoxy resin and a polyester resin since an aqueous dispersion of fine spherical resin particles may be easily obtained.

Here, the vinyl resin is a polymer obtained by homopolymerization or copolymerization of a vinyl monomer, and examples thereof include a styrene-(meth)acrylylate resin, a styrene-butadiene copolymer, a (meth)acrylic acid-acrylate polymer, a styrene-acrylonitrile copolymer, a styrene-maleic anhydride copolymer, and a styrene-(meth)acrylic acid copolymer.

Also, as the resin particles, a copolymer including a monomer having at least two unsaturated groups may be used.

The monomer having at least two unsaturated groups is not particularly restricted and may be appropriately selected according to purpose. Examples thereof include a sodium salt of sulfate of methacrylic acid ethylene oxide adduct (ELEMINOL RS-30, manufactured by Sanyo Chemical Industries, Ltd.), divinylbenzene, and 1,6-hexanediol acrylate.

The resin particles may be obtained by polymerization according to a heretofore known method appropriately selected according to purpose, and it is preferable to obtain as an aqueous dispersion of the resin particles. Examples of a method for preparing the aqueous dispersion of the resin particles include: (i) in the case of the vinyl resin, with a vinyl monomer as a starting material, the aqueous dispersion of the resin particles is directly manufactured by any one polymerization reaction selected from the group consisting of a suspension polymerization method, an emulsion polymerization method, a seed polymerization method and a dispersion polymerization method; (ii) in the case of a polyaddition or a polycondensation resin, e.g. the polyester resin, polyurethane resin, and epoxy resin, a precursor (monomer, oligomer, etc.) or a solvent solution thereof is dispersed in an aqueous medium in the presence of an appropriate dispersant, followed by hardening by heating or adding a hardener to manufacture an aqueous dispersion of the resin particles; (iii) in the case of a polyaddition or polycondensation resin, e.g. the polyester resin, polyurethane resin, epoxy resin, an appropriate emulsifier is dissolved in a precursor (monomer, oligomer, etc.) or a solvent solution thereof (it is preferably a liquid; it may be liquefied by heating), followed by phase inversion emulsification by addition of water; (iv) a resin prepared beforehand by a polymerization reaction (any type of polymerization reaction such as addition polymerization, ring-opening polymerization, polyaddition, addition condensation, and condensation polymerization) is pulverized using a mechanical rotary or jet mill and then classified to obtain resin particles, followed by dispersing them in water in the presence of an appropriate dispersant; (v) a resin solution of a resin prepared beforehand by a polymerization reaction (any type of polymerization reaction such as addition polymerization, ring-opening polymerization, polyaddition, addition condensation, and condensation polymerization) dissolved in a solvent is sprayed to obtain resin particles, followed by dispersing the resin particles in water in the presence of an appropriate dispersant; (vi) a resin solution is prepared by dissolving a resin prepared beforehand by a polymerization reaction (any type of polymerization reaction such as addition polymerization, ring-opening polymerization, polyaddition, addition condensation, and condensation polymerization) in a solvent, resin particles are precipitated by adding a poor solvent to the resin solution or by cooling the resin solution which has been heated and dissolved in a solvent, and then the resin particles are obtained by removing the solvent, followed by dispersing the resin particles in water in the presence of an appropriate dispersant; (vii) a resin solution of a resin prepared beforehand by a polymerization reaction (any type of polymerization reaction such as addition polymerization, ring-opening polymerization, polyaddition, addition condensation, and condensation polymerization) dissolved in a solvent is dispersed in an aqueous medium in the presence of an appropriate dispersant, followed by removing the solvent by heating or reducing a pressure; and (viii) an appropriate emulsifier is dissolved in a resin solution of a resin prepared beforehand by a polymerization reaction (any type of polymerization reaction such as addition polymerization, ring-opening polymerization, polyaddition, addition condensation, and condensation polymerization) dissolved in a solvent, followed by addition of water for phase inversion emulsification.

Also, a dispersant is preferably used in the aqueous medium according to necessity in view of stabilizing oil droplets of the solution or dispersion during emulsification or dispersion described hereinafter to obtain desired shape and at the same time to sharpen its particle size distribution.

The dispersant is not particularly restricted and may be appropriately selected according to purpose. Examples thereof include a surfactant, a hardly water-soluble inorganic compound dispersant, and a polymeric protective colloid. These may be used alone or in combination of two or more. Among these, the surfactant is preferable.

Examples of the surfactant include an anionic surfactant, a cationic surfactant, a non-ionic surfactant, and an amphoteric surfactant.

Examples of the anionic surfactant include alkylbenzene sulfonate, α-olefin sulfonate, a phosphoric acid ester, and an anionic surfactant having a fluoroalkyl group, and the surfactant having a fluoroalkyl group is favorable. Examples of the anionic surfactant having a fluoroalkyl group include fluoroalkylcarboxylic acid having 2 to 10 carbon atoms and a metal salt thereof, disodium perfluorooctanesulfonylglutamate, sodium 3-[omega-fluoroalkyl (6 to 11 carbon atoms)oxy]-1-alkyl (3 to 4 carbon atoms)sulfonate, sodium 3-[omega-fluoroalkanoyl (6 to 8 carbon atoms)-N-ethylamino]-1-propanesulfonate, fluoroalkyl (11 to 20 carbon atoms) carboxylic acid and metal salts thereof, perfluoroalkyl carboxylic acid (7 to 13 carbon atoms) and metal salts thereof, perfluoroalkyl (4 to 12 carbon atoms) sulfonic acid and metal salts thereof, perfluorooctanesulfonic acid diethanolamide, N-propyl-N-(2-hydroxyethyl)perfluorooctanesulfonamide, perfluoroalkyl (6 to 10 carbon atoms) sulfonamide propyltrimethylammonium salts, perfluoroalkyl (6 to 10 carbon atoms)-N-ethylsulfonylglycine salts, and monoperfluoroalkyl (6 to 16 carbon atoms) ethylphosphate esters. Examples of commercially available products of the surfactant having a fluoroalkyl group include SURFLON S-111, S-112, S-113 (manufactured by Asahi Glass Co., Ltd.); FLUORAD FC-93, FC-95, FC-98, FC-129 (manufactured by Sumitomo 3M Co., Ltd.); UNIDYNE DS-101, DS-102 (manufactured by Daikin Industries, Ltd.); MEGAFACE F-110, F-120, F-113, F-191, F-812, F-833 (manufactured by DIC Corporation); EFTOP EF-102, 103, 104, 105, 112, 123A, 123B, 306A, 501, 201, 204 (manufactured by Tochem Products Inc.); and FTERGENT F-100, F150 (manufactured by Neos Company Ltd.).

Examples of the cationic surfactant include an amine salt type surfactant, a quaternary ammonium salt cationic surfactant, and a cationic surfactant having a fluoroalkyl group. Examples of the amine salt type surfactant include an alkylamine salt, an amino alcohol fatty acid derivative, a polyamine fatty acid derivative and imidazoline. Examples of the quaternary ammonium salt cationic surfactant include alkyltrimethyl ammonium salt, dialkyldimethyl ammonium salt, alkyldimethylbenzyl ammonium salt, pyridinium salt, alkyl iso-quinolinium salt and benzethonium chloride. Examples of the cationic surfactant having a fluoroalkyl group include aliphatic primary, secondary and tertiary amine acids including a fluoroalkyl group, a aliphatic quaternary ammonium salt such as perfluoroalkyl (6 to 10 carbon atoms) sulfonamidepropyltrimethylammonium salts, benzalkonium salts, benzethonium chloride, pyridinium salts, and imidazolinium salts.

Examples of commercially available products of the cationic surfactant include: SURFLON S-121 (manufactured by Asahi Glass Co., Ltd.); FLUORAD FC-135 (manufactured by Sumitomo 3M Co., Ltd.); UNIDYNE DS-202 (manufactured by Daikin Industries, Ltd.), MEGAFACE F-150, F-824 (manufactured by DIC Corporation); EFTOP EF-132 (manufactured by Tochem Products Inc.); FTERGENT F-300 (manufactured by Neos Company Ltd.).

Examples of the non-ionic surfactant include a fatty acid amide derivative, and a polyhydric alcohol derivative.

Examples of the amphoteric surfactant include alanine, dodecyldi(aminoethyl)glycine, di(octyl aminoethyl)glycine and N-alkyl-N,N-dimethyl ammonium betaine.

Examples of the hardly water-soluble inorganic compound dispersant include tricalcium phosphate, calcium carbonate, titanium oxide, colloidal silica, and hydroxyapatite.

Examples of the polymeric protective colloid include acids, (meth)acrylic monomers having a hydroxyl group, vinyl alcohol or ethers of vinyl alcohol, esters of vinyl alcohol and a compound having a carboxyl group, amide compounds or methylol compounds thereof, chlorides, homopolymers or copolymers of those having a nitrogen atom or a heterocycle thereof, polyoxyethylenes, and celluloses.

Examples of the acids include acrylic acid, methacrylic acid, α-cyanoacrylic acid, α-cyanomethacrylic acid, itaconic acid, crotonic acid, fumaric acid, maleic acid, and maleic anhydride.

Examples of the (meth)acrylic monomer having a hydroxyl group include β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic acid ester, diethylene glycol monomethacrylic acid ester, glycerin monoacrylic acid ester, glycerin monomethacrylic acid ester, N-methylol acrylamide and N-methylol methacrylamide; vinyl alcohol.

Examples of the vinyl alcohol and the ethers with vinyl alcohol include vinyl methyl ether, vinyl ethyl ether, and vinyl propyl ether. Examples of the esters of vinyl alcohol with a compound having a carboxyl group include vinyl acetate, vinyl propionate, and vinyl butyrate.

Examples of the amide compounds or the methylol compounds thereof include acrylamide, methacrylamide, diacetone acrylamide acid, and methylol compounds thereof. Examples of the chlorides include acrylic acid chloride, and methacrylic acid chloride.

Examples of the homopolymers or the copolymers of those having a nitrogen atom or a heterocyclic ring thereof include vinyl pyridine, vinyl pyrrolidone, vinyl imidazole, and ethylene imine.

Examples of the polyoxyethylenes include polyoxyethylene, polyoxypropylene, polyoxyethylene alkylamine, polyoxypropylene alkylamine, polyoxyethylene alkyl amides, polyoxypropylene alkyl amides, polyoxyethylene nonylphenyl ether, polyoxyethylene laurylphenyl ether, polyoxyethylene stearylphenyl ester, and polyoxyethylene nonylphenyl ester.

Examples of the celluloses include methyl cellulose, hydroxyethyl cellulose, and hydroxypropyl cellulose.

In the preparation of the dispersion, a dispersion stabilizer may be used according to necessity.

Examples of the dispersion stabilizer include those soluble in acid and alkali such as calcium phosphate.

Also, in the case where modified polyester reactive with a compound having an active hydrogen group (prepolymer) is included as a binder resin in the solution or dispersion, a catalyst may be used in the aqueous medium such as dibutyltin laurate, and dioctyltin laurate for the reaction.

(3) Emulsification or Dispersion

Emulsification or dispersion of the solution or dispersion of the toner material in the aqueous medium is preferably carried out by dispersing the solution or dispersion of the toner material in the aqueous medium with stirring. A method for the dispersion is not particularly restricted and may be appropriately selected according to purpose. Examples thereof include: batch emulsifying machines such as HOMOGENIZER (manufactured by IKA), POLYTRON (manufactured by Kinematica AG), and TK AUTOHOMOMIXER (manufactured by Primix Corporation); continuous emulsifying machines such as EBARA MILDER (manufactured by Ebara Corporation), T.K. FILMICS and T.K. PIPELINE HOMOMIXER (manufactured by Primix Corporation), Colloid Mill (manufactured by Shinko Pantec Co., Ltd.), slashers, Trigonal Wet Micropulverizer (manufactured by Mitsui Miike Kakoki Co.), CAPITRON (manufactured by Eurotech Co., Ltd.), and FINE FLOW MILL (manufactured by Pacific Machinery & Engineering Co., Ltd.); high-pressure emulsifying machines such as MICROFLUIDIZER (manufactured by Mizuho Industrial Co., Ltd.), NANOMIZER (manufactured by Nanomizer Inc.), and AVP GAULIN (manufactured by Gaulin Inc); membrane emulsifiers such as MEMBRANE EMULSIFIER (manufactured by REICA Co., Ltd.); vibration emulsifiers such as VIBRO MIXER (manufactured by REICA Co.); and ultrasonic emulsifiers such as an ultrasonic homogenizer (manufactured by BRANSON). Among these, in view of uniform particle diameter, AVP GAULIN, HOMOGENIZER, TK AUTOHOMOMIXER, EBARA MILDER, T.K. FILMICS, and T.K. PIPELINE HOMOMIXER are particularly preferable.

(4) Removal of Solvent

The organic solvent is removed from the emulsified slurry obtained by the emulsification or dispersion.

Examples of the removal of the organic solvent include: (1) by gradually increasing the temperature of the whole reaction system, the organic solvent in the oil droplets are completely evaporated and removed; and (2) emulsified dispersion is sprayed in a dry atmosphere to remove completely the non-aqueous organic solvent in the oil droplets and form toner particles, and at the same time the aqueous dispersant is evaporated and removed.

(5) Washing, Drying and Classifying

Toner particles are formed once the organic solvent is removed. The toner particles may be subjected to washing and drying and further to classification thereafter if desired. The classification may be carried out by removing fine particles by a cyclone, decanter or centrifuge in the liquid, and it is possible to carry out classification operation after drying to obtain toner powder. Here, in the case where the dispersion stabilizer soluble in acid or alkali such as calcium phosphate is used in the aqueous medium, the dispersion stabilizer may be removed from the toner particles by dissolving it with acids such as hydrochloric acid followed by rinsing.

(6) External Additives Such as Charge Controlling Agent and Releasing Agent

Thus obtained toner particles are mixed with particles such as releasing agent and charge controlling agent, e.g. inorganic fine particles including silica fine particles or titanium oxide fine particles, or further subjected to mechanical impact according to necessity, and thereby departure of the particles such as releasing agent from a surface of the toner particles may be prevented.

As a method for applying the mechanical impact, for example, there are methods to apply an impact force to a mixture using blades rotating at a high speed and a method to put the mixture in a high-speed airflow, which is accelerated to have the particles collide with one another or against a suitable collision plate. Examples of an apparatus used for these methods include ANGMILL (manufactured by Hosokawa Micron Co., Ltd.), a remodeled apparatus of I-TYPE MILL (manufactured by Nippon Pneumatic Mfg. Co., Ltd.) with a reduced grinding air pressure, HYBRIDIZATION SYSTEM (manufactured by Nara Kikai Seisakusho Co., Ltd.), KRYPTRON SERIES (manufactured by Kawasaki Heavy Industries, Ltd.) and an automatic mortar.

A toner of the present invention is not particularly restricted in terms of its properties such as shape and composition and may be appropriately selected according to purpose. Nonetheless, it is preferably to include the following volume-average particle diameter (Dv), volume-average particle diameter (Dv)/number-average particle diameter (Dn), penetration, low-temperature fixing property, and offset non-occurring temperature.

The volume-average particle diameter (Dv) of the toner is not particularly restricted and may be appropriately selected according to purpose. Nonetheless, it is preferably 3 μm to 8 μm. When the volume-average particle diameter is less than 3 μm, the toner in a two-component developer fuses on a surface of a carrier after a long-term stirring in a developing device, resulting in reduction of charging performance of the carrier, and the toner in a one-component developer tends to cause filming on a developing roller or fuse on a member such as blades which thins the toner. When it exceeds 8 μm, it becomes difficult to obtain a high-resolution, high-quality image. Variation of the particle diameter of the toner may increase when the toner in the developer is balanced.

A ratio (Dv/Dn) of the volume-average particle diameter (Dv) to the number-average particle diameter (Dn) in the toner is not particularly restricted and may be appropriately selected according to purpose. Nonetheless, it is more preferably 1.00 to 1.25.

When the ratio (Dv/Dn) of the volume-average particle diameter to the number-average particle diameter is less than 1.00, the toner in a two-component developer fuses on a surface of a carrier after a long-term stirring in a developing device, resulting in reduction of charging performance or degradation of cleanability of the carrier, and the toner in a one-component developer tends to cause filming on a developing roller or fuse on a member such as blades which thins the toner. When it exceeds 1.30, it becomes difficult to obtain a high-resolution, high-quality image. Variation of the particle diameter of the toner may increase when the toner in the developer is balanced.

When the ratio of the volume-average particle diameter to the number-average particle diameter (Dv/Dn) is 1.00 to 1.25, the toner has excellent storage stability, low-temperature fixing property and hot-offset resistance, and in particular, it produces an image having excellent glossiness when it is used in a full-color copier. In a two-component developer, variation of the particle diameter of the toner is small when the toner in the developer is balanced over a long period of time, and favorable and stable developing property may be achieved after a long-term stirring in a developing device. In a one-component developer, variation of the particle diameter of the toner is small even after the toner is balanced, and moreover, it does not cause filming on a developing roller or fuse on a member such as blades which thins the toner, and favorable and stable developing property may be achieved after a long-term usage (stirring) in the developing device. Thus, a high-quality image may be obtained.

The volume-average particle diameter and the ratio of the volume-average particle diameter and the number-average particle diameter (Dv/Dn) may be measured using, for example, a particle size measuring instrument "MULTISIZER IL," manufactured by Beckman Coulter.

The penetration is not particularly restricted and may be appropriately selected according to purpose. Nonetheless, the penetration measured, for example, by a penetration test (JIS K2235-1991) is preferably 15 mm or greater, and more preferably 25 mm or greater.

When the penetration is less than 15 mm, heat-resistant storage stability may degrade.

The penetration may be measured in accordance with JIS K2235-1991. Specifically, a toner is filled in a 50-mL glass container, which is allowed to stand for 20 hours in a thermostatic chamber at 50° C. This toner is cooled to a room temperature and subjected to the penetration test, and penetration may be measured. Here, a larger value of the penetration indicates more superior heat-resistant storage stability.

As low-temperature fixing property, in view of obtaining reduced fixing temperature and non-occurrence of offset, a smaller lower-limit fixing temperature is preferable, and a higher offset non-occurring temperature is preferable. A temperature region in which both reduced fixing temperature and non-occurrence of offset may be obtained is that the lower-limit fixing temperature is less than 130° C. and that the offset non-occurring temperature is 180° C. or greater.

The lower-limit fixing temperature is defined as follows, for example. Using an image forming apparatus in which a recording medium is set, a copying test is carried out. An obtained fixed image is rubbed with a pad, and a fixing roll temperature at which a remaining ratio of the image density thereof is 70% or greater is defined as the lower-limit fixing temperature.

The offset non-occurring temperature may be obtained as follows, for example. An image forming apparatus in which a recording medium is set is adjusted so that solid images of single colors of yellow, magenta, cyan and black as well as intermediate colors of red, blue and green are respectively developed and that a temperature of its fixing belt may be varied, and a temperature at which offset does not occur is measured.

Coloring of the toner of the present invention is not particularly restricted and may be appropriately selected according to purpose. It may be at least one type selected from the group consisting of a black toner, a cyan toner, a magenta toner and a yellow toner, and the toner of each color may be obtained by selecting appropriate types of the colorant.

(Developer)

A developer of the present invention includes at least the toner of the present invention, and it further includes other components appropriately selected such as carrier. The developer may be a one-component developer or a two-component developer, but it is preferably the two-component developer in view of improving lifetime when it is used in a high-speed printer which complies with improved information processing speed in recent years.

For the one-component developer using the toner of the present invention, variation of the particle diameter of the toner is small even after the toner is balanced, and moreover, it does not cause filming on a developing roller or fuse on a member such as blades which thins the toner, and favorable and stable developing property may be achieved after a long-term usage (stirring) in a developing device. Also, for the two-component developer using the toner of the present invention, variation of the particle diameter of the toner is small when the toner in the developer is balanced over a long period of time, and favorable and stable developing property may be achieved after a long-term stirring in a developing device.

The carrier is not particularly restricted and may be appropriately selected according to purpose. Nonetheless, one including a core material and a resin layer which coats the core material is preferable.

A material of the core material is not particularly restricted and may be appropriately selected according to purpose. For example, a manganese-strontium (Mg—Sr) material and a manganese-magnesium (Mn—Mg) material of 50 emu/g to 90 emu/g are preferable, and in view of ensuring image density, a high-magnetization material such as iron powder (100 emu/g or greater) and magnetite (75 emu/g to 120 emu/g) are preferable. In addition, a low-magnetization material such as copper-zinc (Cu—Zn) material (30 emu/g to 80 emu/g) is preferable since it is advantageous in terms of image quality by weakening the toner in a state of ear standing on a photoconductor. These may be used alone or in combination of two or more.

A particle diameter of the core material is not particularly restricted and may be appropriately selected according to purpose. Nonetheless, the particle diameter as a volume-average particle diameter is preferably 10 μm to 150 μm, and more preferably 20 μm to 80 μm.

When the volume-average particle diameter is less than 10 μm, fine powder increases in a distribution of the carrier particles, and magnetization per one particle may decrease. This may result in carrier scattering. When it exceeds 150 μm, specific surface area decreases, which may result in toner scattering. In a full-color printing having many solid portions, reproduction of the solid portions may degrade in particular.

A material of the resin layer is not particularly restricted and may be appropriately selected from heretofore known resins according to purpose. Nonetheless, examples thereof include an amino resin, a polyvinyl resin, a polystyrene resin, a halogenated olefin resin, a polyester resin, a polycarbonate resin, a polyethylene resin, a polyvinyl fluoride resin, a polyvinylidene fluoride resin, a polytrifluoroethylene resin, a polyhexafluoropropylene resin, a copolymer of vinylidene fluoride and acrylic monomer, a copolymer of vinylidene fluoride and vinyl fluoride, a fluoro-terpolymer such as terpolymer of tetrafluoroethylene, vinylidene fluoride and non-fluorinated monomer, and a silicone resin. These may be used alone or in combination of two or more.

Examples of the amino resin include a urea-formaldehyde resin, a melamine resin, a benzoguanamine resin, a urea resin, a polyamide resin, and an epoxy resin. Examples of the polyvinyl resin include an acrylic resin, a polymethyl methacrylate resin, a polyacrylonitrile resin, a polyvinyl acetate resin, a polyvinyl alcohol resin, and a polyvinyl butyral resin. Examples of the polystyrene resin include a polystyrene resin, and a styrene-acrylic copolymer resin. Examples of the halogenated olefin resin include polyvinyl chloride. Examples of the polyester resin include a polyethylene terephthalate resin, and a polybutylene terephthalate resin.

The resin layer is not particularly restricted, and electrically conductive powder, etc. may be included according to necessity. Examples of the electrically conductive powder include metal powder, carbon black, titanium oxide, tin oxide, and zinc oxide. An average particle diameter of these electrically conductive powders is preferably 1 μm or less. When the average particle diameter exceeds 1 μm, it may be difficult to control electric resistance.

The resin layer may be formed by, for example, dissolving the resin such as silicone resin in a solvent to prepare a coating solution, followed by applying the coating solution uniformly on a surface of the core material by a heretofore known coating method, which is dried and baked. Examples of the coating method include dipping, spraying and brushing.

The solvent is not particularly restricted and may be appropriately selected according to purpose. Nonetheless, examples thereof include toluene, xylene, methyl ethyl ketone, methyl isobutyl ketone, and butyl cellosolve acetate.

The baking is not particularly restricted, and it may be an external heating method or an internal heating method. Examples thereof include methods using a stationary electric furnace, a fluidized electric furnace, a rotary electric furnace or a burner furnace and a method using microwave.

An amount of the carrier in the resin layer is not particularly restricted and may be appropriately selected according to purpose. Nonetheless, it is preferably 0.01% by mass to 5.0% by mass. When the amount is less than 0.01% by mass, the resin layer may not be formed uniformly on a surface of the core material. When it exceeds 5.0% by mass, the resin layer is too thick, causing agglomeration within the carrier, and uniform carrier particles may not be obtained.

When the developer is the two-component developer, a content of the carrier in the two-component developer is not particularly restricted and may be appropriately selected according to purpose. It is preferably 90% by mass to 98% by mass, and more preferably 93% by mass to 97% by mass.

<Process Cartridge>

A process cartridge used in the present invention includes at least: an electrostatic latent image bearing member which carries an electrostatic latent image; and a developing unit which develops the electrostatic latent image carried on the electrostatic latent image bearing member using a toner to form a visible image, and it further includes other units appropriately selected according to necessity.

The developing unit includes at least: a developer container which contains the developer of the present invention; and a developer bearing member which carries and transports the developer contained in the developer container, and it may further include a layer thickness regulating member for regulating a layer thickness of the toner being carried.

The process cartridge may be detachably mounted in an image forming apparatus of various kinds, and it is preferable that it is detachably mounted in an image forming apparatus of the present invention described hereinafter.

Figure 4:
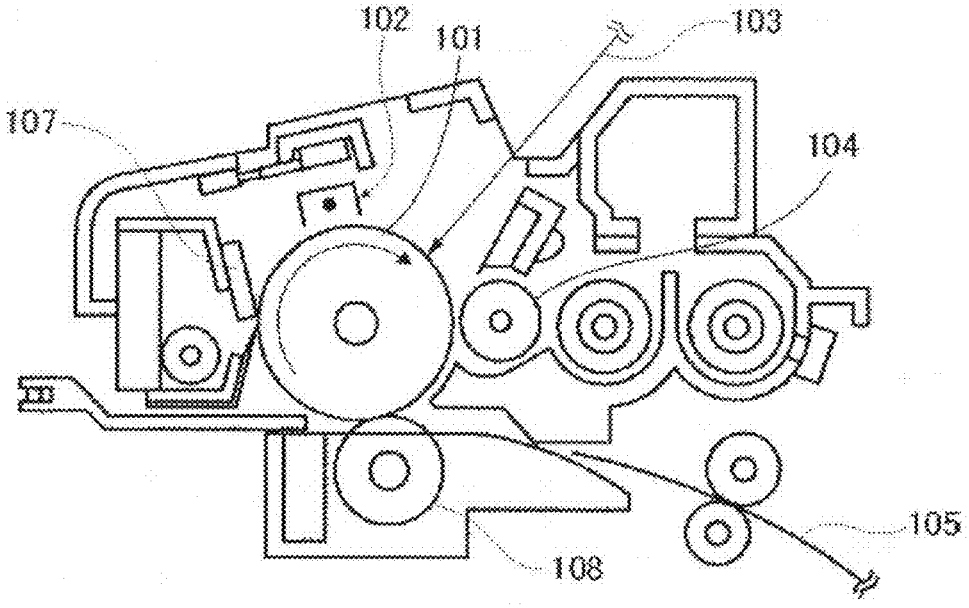
FIG. 4 is a schematic explanatory diagram illustrating one example of a process cartridge used in the present invention.

Here, for example, as illustrated in FIG. 4, the process cartridge incorporates an electrostatic latent image bearing member 101, includes a charging unit 102, a developing unit 104, a transfer unit 108, and a cleaning unit 107, and further includes other units according to necessity other. In FIGS. 4, 103 and 105 denote exposure by an exposure unit and a recording medium, respectively.

Next, an image forming process by the process cartridge illustrated in FIG. 4 is described. The electrostatic latent image bearing member 101 is subjected to charging by the charging unit 102 and exposure 103 by an exposure unit (not shown) while rotating in a direction of an arrow, and an electrostatic latent image corresponding an exposure image is formed on a surface thereof. This electrostatic latent image is developed by the developing unit 104, and an obtained visible image is transferred to the recording medium 105 by the transfer unit 108 and printed out. Next, a surface of the electrostatic latent image bearing member after image transfer is cleaned by the cleaning unit 107 and further neutralized by a neutralizing unit (not shown), and the above operations are repeated again.

(Image Forming Method and Image Forming Apparatus)

An image forming method used in the present invention includes at least an electrostatic latent image formation step, a developing step, a transfer step, and a fixing step, and it further includes other steps such as neutralizing step, cleaning step, recycling step, and controlling step appropriately selected according to necessity.

An image forming apparatus of the present invention includes at least an electrostatic latent image bearing member, an electrostatic latent image forming unit, a developing unit, a transfer unit, and a fixing unit, and it further includes other units such as neutralizing unit, cleaning unit, recycling unit, and controlling unit appropriately selected according to necessity.

The electrostatic latent image formation step is a step of forming an electrostatic latent image on the electrostatic latent image bearing member, and it includes a charging step and an exposing step.

The electrostatic latent image bearing member (which may also be referred to as "electrophotographic photoconductor", "photoconductor", or "image bearing member") is not particularly restricted in terms of its material, shape, structure and composition, and it may be appropriately selected from heretofore known ones. As the shape, a drum shape is favorable. Examples of the material include an inorganic photoconductor of amorphous silicon or selenium and an organic photoconductor (OPC) of polysilane or phthalopolymethine. Among these, amorphous silicon is preferable.

The electrostatic latent image may be formed by uniformly charging a surface of the electrostatic latent image bearing member followed by imagewise exposure, which may be carried out by the electrostatic latent image forming unit.

For example, the electrostatic latent image forming unit includes at least a charger which uniformly charges the surface of the electrostatic latent image bearing member and an exposure device which exposes imagewise the surface of the electrostatic latent image bearing member.

The charging may be carried out by applying a voltage to the surface of the electrostatic latent image bearing member using the charger.

The charger is not particularly restricted and may be appropriately selected according to purpose. Examples thereof include: contact charger heretofore known per se equipped with electrically conductive or semi-conductive roller, brush, film or rubber blade; and a non-contact charger which makes use of corona discharge of corotron or scorotron.

Also, it is preferable that the charger is disposed in contact or non-contact with the electrostatic latent image bearing member and applies superimposed DC and AC voltages, thereby charging the surface of the electrostatic latent image bearing member.

It is also preferable that the charger is a charging roller disposed closely to the electrostatic latent image bearing member via a gap tape in a non-contact manner and applies superimposed DC and AC voltages, thereby charging the surface of the electrostatic latent image bearing member.

The exposure may be carried out by exposing imagewise the surface of the electrostatic latent image bearing member using the exposure device.

The exposure device is not particularly restricted as long as it can expose imagewise an image to be formed on the surface of the electrostatic latent image bearing member charged by the charger, and it may be selected appropriately according to purpose. Examples thereof include various exposure devices such as copying optical system, rod lens array system, laser optical system and liquid-crystal shutter optical system.

Here, in the present invention, a back light system which exposes imagewise from a back side of the electrostatic latent image bearing member.

—Developing Step and Developing Unit—

The developing step is a step of developing the electrostatic latent image using the toner of the present invention to form a visible image.

The formation of the visible image may be carried out, for example, by developing the electrostatic latent image using the toner or the developer of the present invention, and it is carried out by the developing unit.

The developing unit is not particularly restricted as long as it may develop using, for example, the toner or the developer of the present invention, and it may be appropriately selected from heretofore known units. As a favorable example, the developing unit includes a developing device which contains the toner or the developer of the present invention and which may apply the developer to the electrostatic latent image in a contact or non-contact manner.

The developing device may be a dry-type developing system or a wet-type developing system. Also, it may be a single-color developing device or a multi-color developing device. As a favorable example, it includes a stirrer which charges the developer by frictional stirring and a rotatable magnet roller.

In the developing device, for example, the toner and the carrier are mixed and stirred, and friction thereby charges the toner. The toner is maintained on a surface of the rotating magnet roller in a state of ear standing, and a magnetic brush is formed. Since the magnet roller is disposed near the electrostatic latent image bearing member, a part of the toner which constitutes the magnetic brush formed on the surface of the magnet roller moves to a surface of the electrostatic latent image bearing member by an electrical attraction force. As a result, the electrostatic latent image is developed by the toner, and a visible image is formed by the toner on a surface of the electrostatic latent image bearing member.

—Transfer Step and Transfer Unit—

The transfer step is a step to transfer the visible image to a recording medium, and a preferable aspect thereof includes a primary transfer of the visible image on the intermediate transfer member using an intermediate transfer member followed by a secondary transfer of the visible image to the recording medium. An aspect which includes a primary transfer step in which a visible image is transferred using two or more colors, or preferably a full-color toner, as the toner is transferred on an intermediate transfer member to form a composite transfer image, and a secondary transfer step in which the composite transfer image is transferred on the recording medium is more preferable.

The transfer may be carried out, for example, by charging the visible image on the electrostatic latent image bearing member using a transfer charger, and it may be carried out by the transfer unit. As the transfer unit, an aspect including a primary transfer unit which forms a composite transfer image by transferring a visible image on an intermediate transfer member, and a secondary transfer unit which transfers the composite transfer image to a recording medium is preferable.

Here, the intermediate transfer member is not particularly restricted and may be appropriately selected from heretofore known transfer members according to purpose, and favorable examples thereof include a transfer belt.

The transfer unit (the primary transfer unit and the secondary transfer unit) preferably includes at least a transfer device which peels and charges the visible image formed on the electrostatic latent image bearing member to a side of the recording medium. The transfer unit may be one, or two or more.

Examples of the transfer device include a corona transfer device by corona discharge, a transfer belt, a transfer roller, a pressure transfer roller, and an adhesive transfer device.

Here, the recording medium is not particularly restricted and may be appropriately selected from heretofore known recording media (recording paper).

The fixing step is a step of fixing the visible image transferred on the recording medium using a fixing unit. It may be carried out every time a toner of one color is transferred to the recording medium, or it may be carried out once toners of all the colors are laminated.

The fixing apparatus is not particularly restricted and may be appropriately selected according to purpose. Nonetheless, heretofore known heating and pressurizing units are preferable. Examples of the heating and pressurizing units include a combination of a heat roller and a pressure roller, and a combination of a heat roller, a pressure roller and an endless belt.

The fixing apparatus preferably includes a heating member equipped with a heating element, a film in contact with the heating member, and a pressure member in pressure contact with the heating member via the film, wherein the heating and fixing is carried out by passing a recording medium on which a non-fixed image is formed between the film and the pressurizing member. Usually, heating in the heating and pressurizing member is preferably 80° C. to 200° C.

Here, in the present invention, a heretofore known optical fixing device may be used, for example, along with or in place of the fixing step and fixing unit according to purpose.

The neutralizing step is a step of neutralizing the electrostatic latent image bearing member by applying a neutralizing bias, and it may be favorably carried out by a neutralizing unit.

The neutralizing unit is not particularly restricted as long as the neutralizing bias is applied on the electrostatic latent image bearing member and may be appropriately selected from heretofore known neutralizing devices. Favorable examples thereof include a neutralizing lamp.

The cleaning step is a step of removing the toner remaining on the electrostatic latent image bearing member, and it may be favorably carried out by a cleaning unit.

The cleaning unit is not particularly restricted as long as the electrophotographic toner remaining on the electrostatic latent image bearing member is removed, and it may be appropriately selected from heretofore known cleaners. Favorable examples thereof include a magnetic brush cleaner, an electrostatic brush cleaner, a magnetic roller cleaner, a blade cleaner, a brush cleaner, and a web cleaner.

The recycling step is a step of recycling the toner removed by the cleaning step to the developing unit, and it may be favorably carried out by a recycling unit.

The recycling unit is not particularly restricted, and examples thereof include a heretofore known conveying unit.

The controlling step is a step of controlling the each step, and it may be favorably carried out by a controlling unit.

The controlling unit is not particularly restricted as long as it controls operations of the each unit, and it may be appropriately selected according to purpose. Examples thereof include devices such as sequencer and computer.

Figure 5:
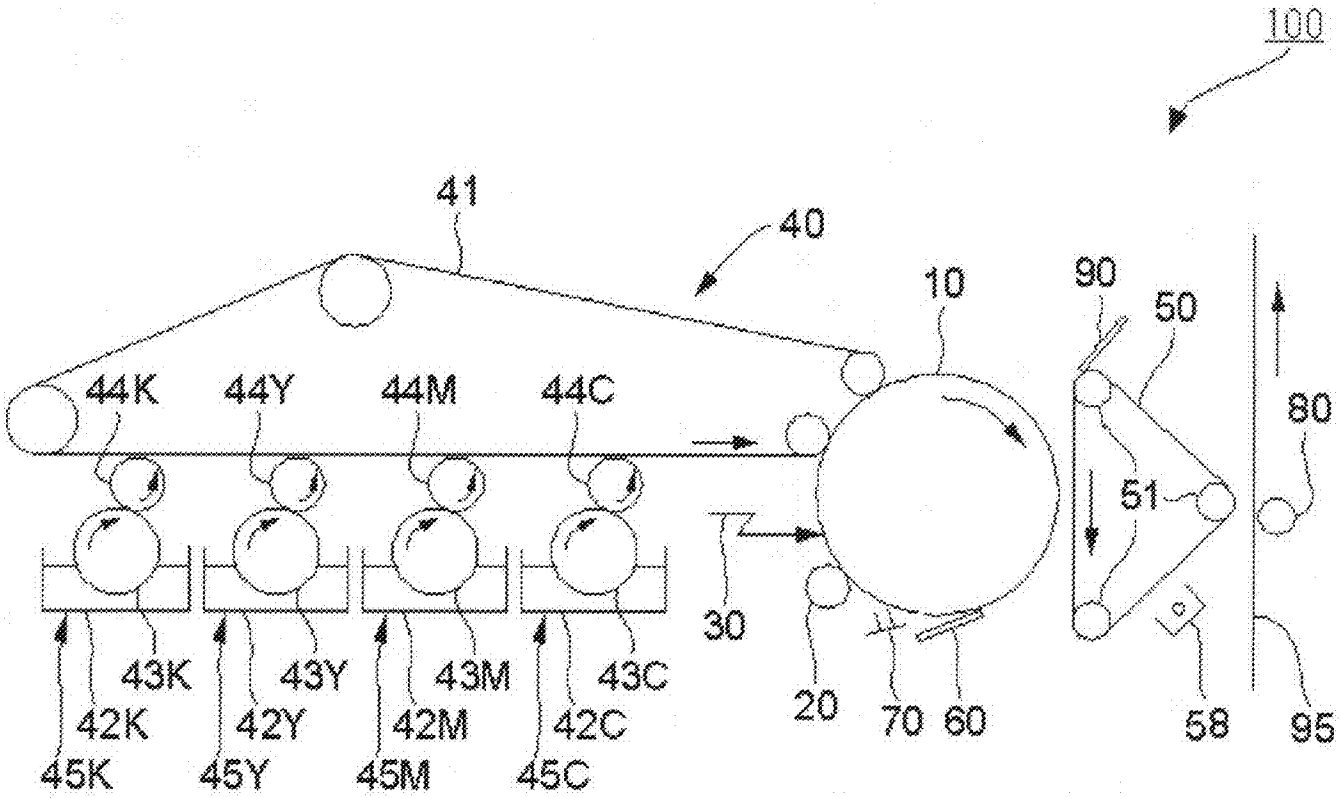
FIG. 5 is a schematic explanatory diagram illustrating one example of an image forming apparatus of the present invention.

One aspect of implementing the image forming method used in the present invention by the image forming apparatus of the present invention is explained in reference to FIG. 5. An image forming apparatus 100 illustrated in FIG. 5 is equipped with a photoconductor drum 10 as the electrostatic latent image bearing member (hereinafter, it may also be referred to as a "photoconductor 10"), a charging roller 20 as the charging unit, an exposure apparatus 30 as the exposure unit, a developing apparatus 40 as the developing unit, an intermediate transfer member 50, a cleaning apparatus 60 including a cleaning blade as the cleaning unit, and a neutralizing lamp 70 as the neutralizing unit.

The intermediate transfer member 50 is an endless belt, and it is designed to be movable in a direction of an arrow in the figure by three rollers 51 which are disposed within the belt and stretch the belt. A part of the three rollers 51 also functions as a transfer bias roller which may apply a predetermined transfer bias (primary transfer bias) to the intermediate transfer member 50. The cleaning blade 90 for the intermediate transfer member is disposed near the intermediate transfer member 50, and also a transfer roller 80 as the transfer unit which may apply a transfer bias for transferring a visible image (toner image) to a recording medium 95 (secondary transfer) is disposed facing the intermediate transfer member 50. Around the intermediate transfer member 50, a corona charger 58 for imparting a charge to the visible image on this intermediate transfer member 50 is disposed in a direction of rotation in the intermediate transfer member 50 between a contacting portion of the photoconductor 10 and the intermediate transfer member 50 and a contacting portion of the intermediate transfer member 50 and the recording medium 95.

The developing apparatus 40 is configured with a developing belt 41 as a developer bearing member, and a black developing unit 45K, a yellow developing unit 45Y, a magenta developing unit 45M and a cyan developing unit 45C disposed around this developing belt 41. Here, the black developing unit 45K is equipped with a developer container 42K, a developer supply roller 43K and a developing roller 44K. The yellow developing unit 45Y is equipped with a developer container 42Y, a developer supply roller 43Y and a developing roller 44Y. The magenta developing unit 45M is equipped with a developer container 42M, a developer supply roller 43M and a developing roller 44M. The cyan developing unit 45C is equipped with a developer container 42C, a developer supply roller 43C and a developing roller 44C. Also, the developing belt 41 is an endless belt, rotatably stretched by a plurality of belt rollers, and a part thereof is in contact with the electrostatic latent image bearing member 10.

In the image forming apparatus 100 illustrated in FIG. 5, for example, the charging roller 20 uniformly charges the photoconductor drum 10. The exposure apparatus 30 carries out an image-wise exposure on the photoconductor drum 10, and an electrostatic latent image is formed. The electrostatic latent image formed on the photoconductor drum 10 is developed by a toner supplied by the developing apparatus 40, and a visible image (toner image) is formed. The visible image (toner image) is transferred from a roller 51 to the intermediate transfer member 50 by an applied voltage (primary transfer), and further transferred to the recording medium 95 (secondary transfer). As a result, a transfer image is formed on the recording medium 95. Here, a residual toner on the photoconductor 10 is removed by the cleaning apparatus 60, and the charge on the photoconductor 10 is once removed by the neutralizing lamp 70.

Figure 6:
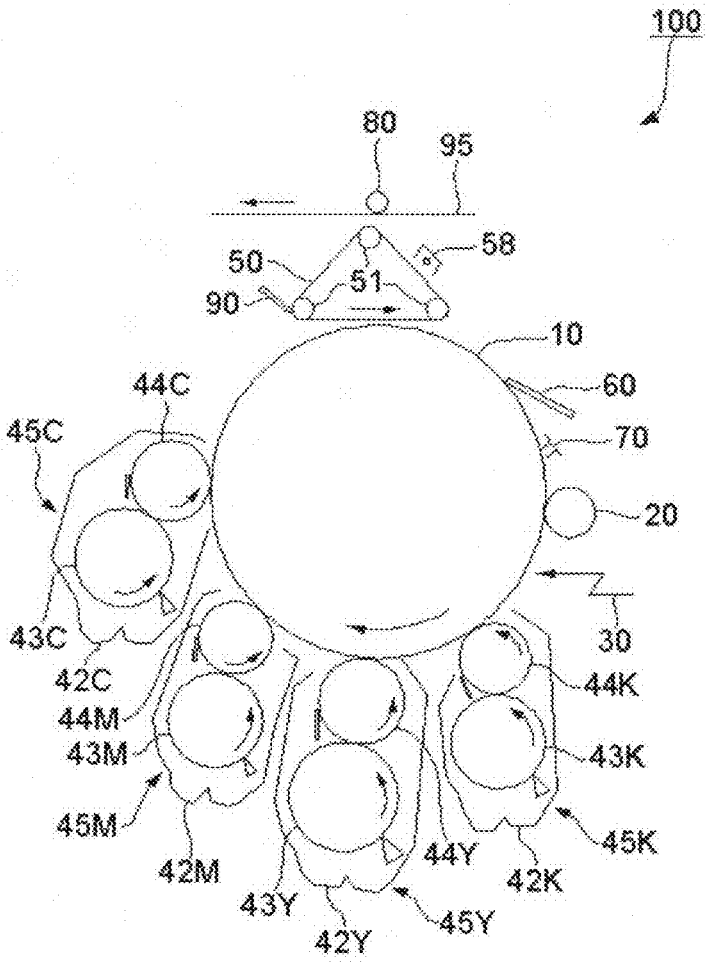
FIG. 6 is a schematic explanatory diagram illustrating another example of an image forming apparatus of the present invention.

Another aspect of implementing the image forming method used in the present invention by the image forming apparatus of the present invention is explained in reference to FIG. 6. An image forming apparatus 100 illustrated in FIG. 6 is not equipped with the developing belt 41 in the image forming apparatus 100 illustrated in FIG. 5, and it has a similar configuration as the image forming apparatus 100 illustrated in FIG. 5 except that a black developing unit 45K, a yellow developing unit 45Y, a magenta developing unit 45M and a cyan developing unit 45C are disposed around a photoconductor 10 and directly facing the photoconductor 10, and it exhibits the same effect. Here, in FIG. 6, elements which are the same as those in FIG. 5 are identified with the same reference signs.

Figure 7:
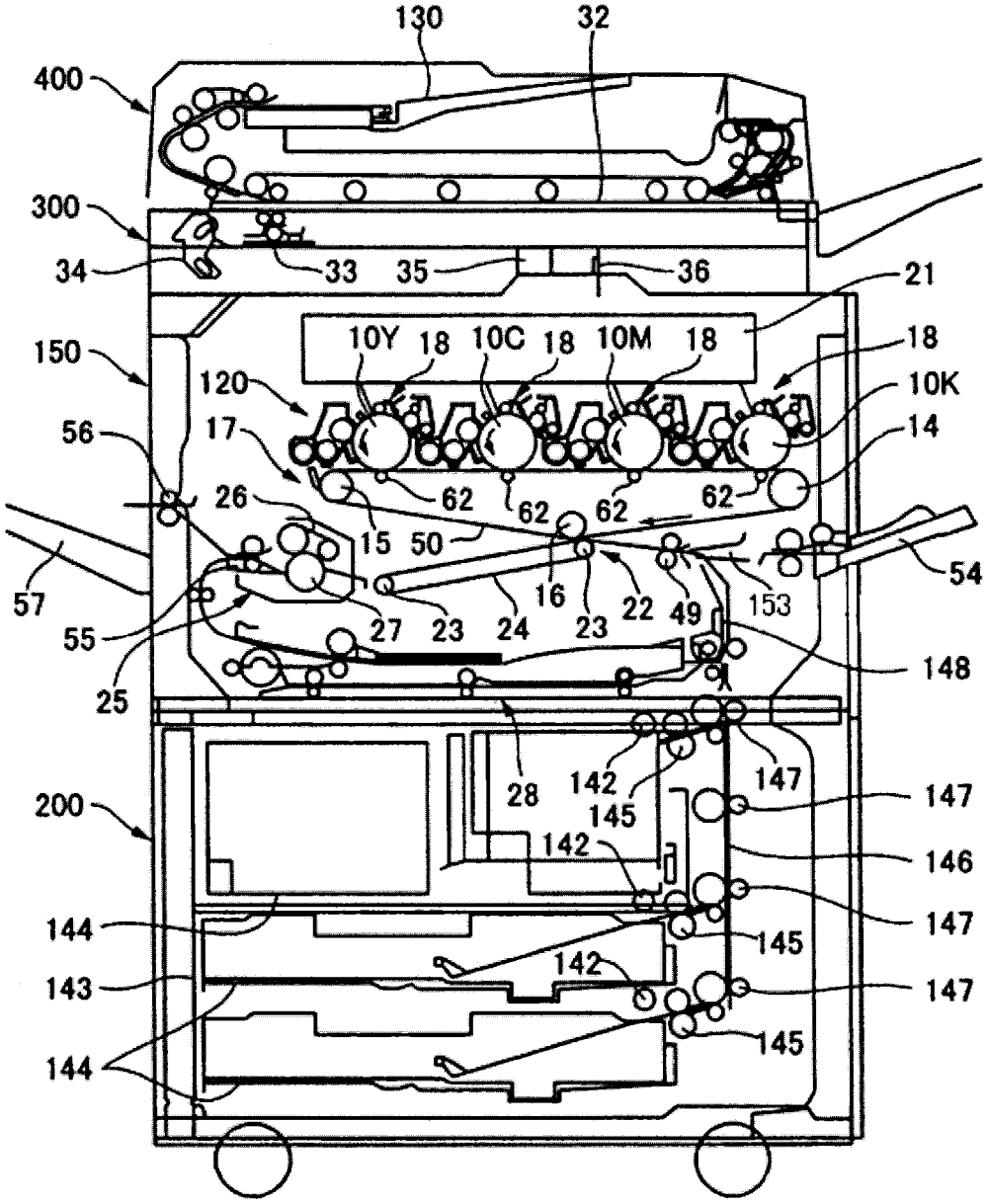
FIG. 7 is a schematic explanatory diagram illustrating one example of a tandem color image forming apparatus of the present invention.

Another aspect of implementing the image forming method used in the present invention by the image forming apparatus of the present invention is explained in reference to FIG. 7. A tandem image forming apparatus illustrated in FIG. 7 is a tandem color image forming apparatus. This tandem image forming apparatus is equipped with a copying apparatus main body 150, a paper feed table 200, a scanner 300, and an automatic document feeder (ADF) 400.

An intermediate transfer member 50 is disposed at a central portion of the copying apparatus main body 150, and the intermediate transfer member 50 is stretched by support rollers 14, 15 and 16 and is rotatable in a clockwise direction in FIG. 7. Near the support roller 15, an intermediate transfer member cleaning apparatus 17 is disposed for removing a residual toner on the intermediate transfer member 50. A tandem developing device 120 is disposed such that four image forming units 18 of yellow, cyan, magenta and black are disposed in parallel along a conveying direction thereof facing the intermediate transfer member 50 stretched by the support roller 14 and the support roller 15. Near the tandem developing device 120, an exposure apparatus 21 is disposed. On a side of the intermediate transfer member 50 opposite from the side on which the tandem developing device 120 is disposed, a secondary transfer apparatus 22 is disposed. In the secondary transfer apparatus 22, a secondary transfer belt 24 as an endless belt is stretched by a pair of rollers 23, and a recording medium conveyed on the secondary transfer belt 24 and the intermediate transfer member 50 may be in contact with each other. Near the secondary transfer apparatus 22, a fixing apparatus 25 is disposed. The fixing apparatus 25 is equipped with a fixing belt 26 as an endless belt and a pressure roller 27 pressed by the fixing belt 26.

Here, in the tandem image forming apparatus, near the transfer apparatus 22 and the fixing apparatus 25, a sheet inverting apparatus 28 is disposed for inverting a recording medium so that an image is formed on both sides of the recording medium.

Next, a full-color image formation (color copy) using the tandem developing device 120 is explained. That is, first, a color document is set on a document table 130 of the automatic document feeder (ADF) 400. Alternatively, the automatic document feeder 400 is opened, the document is set on a contact glass 32 of the scanner 300, and the automatic document feeder 400 is closed.

A start button (not shown) is pressed. The scanner 300 activates after the document is conveyed and transferred to the contact glass 32 in the case the document has been set on the automatic document feeder 400, or right away in the case the document has been set on the contact glass 32, and a first travelling body 33 equipped with a light source and a second travelling body 34 equipped with a mirror travel. At this time, a light irradiated from the first travelling body 33 is reflected from a surface of the document, and the reflected light is reflected by the second travelling body 34, which is received by a reading sensor 36 through an imaging lens 35. The color document (color image) is read thereby, and black, yellow, magenta and cyan image information may be obtained.

Figure 8:
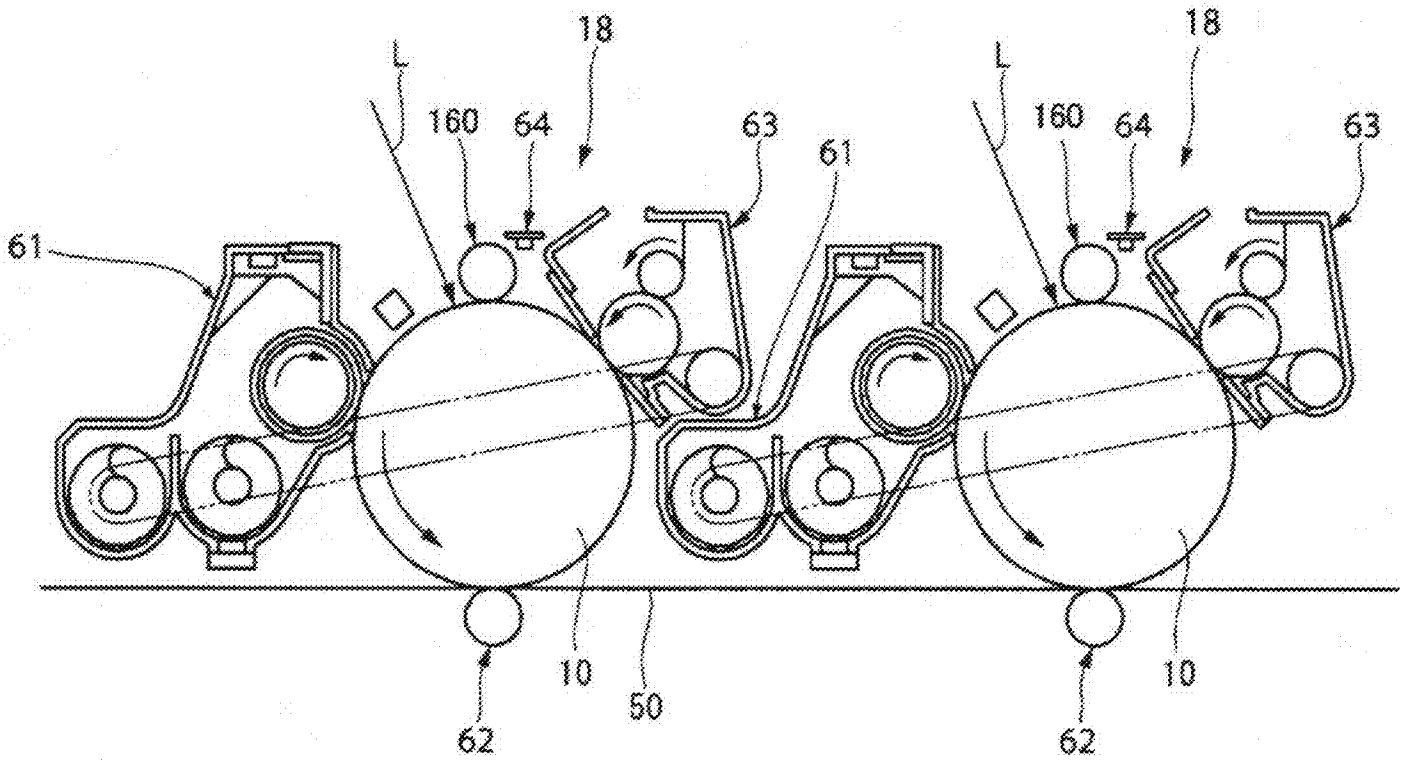
FIG. 8 is a partially enlarged schematic explanatory diagram of the image forming apparatus illustrated in FIG. 7.

Then, the black, yellow, magenta, and cyan image information are transmitted to respective image forming unit 18 (a black image forming unit, a yellow image forming unit, a magenta image forming unit, and a cyan image forming unit) in the tandem developing device 120, and in the respective image forming units, black, yellow, magenta, and cyan toner images of are respectively formed. That is, each of the image forming units 18 (the black image forming unit, the yellow image forming unit, the magenta image forming unit and the cyan image forming unit) in the tandem developing device 120 is equipped with, as illustrated in FIG. 8; an electrostatic latent image bearing member 10 (a black electrostatic latent image bearing member 10K, a yellow electrostatic latent image bearing member 10Y, a magenta electrostatic latent image bearing member 10M, and a cyan electrostatic latent image bearing member 10C); a charging apparatus 160 which uniformly charges the electrostatic latent image bearing member 10; an exposure apparatus which exposes the electrostatic latent image bearing member (L in FIG. 8) in an imagewise manner of each color image based on each color image information to form an electrostatic latent image corresponding to each color image on the electrostatic latent image bearing member; a developing apparatus 61 which develops the electrostatic latent image using each color toner (a black toner, a yellow toner, a magenta toner, and a cyan toner) to form a toner image of the respective color toner; a transfer charger 62 for transferring the toner image to the intermediate transfer member 50; a cleaning apparatus 63; and a neutralizing device 64, and an image of a single color (a black image, a yellow image, a magenta image, and a cyan image) may be formed based on the image information. Regarding the black image, the yellow image, the magenta image and the cyan image thus formed, the black image formed on the black electrostatic latent image bearing member 10K, the yellow image formed on the yellow electrostatic latent image bearing member 10Y, the magenta image formed on the magenta electrostatic latent image bearing member 10M, and the cyan image formed on the cyan electrostatic latent image bearing member 10C are sequentially transferred on the intermediate transfer member 50 rotationally moved by support rollers 14, 15 and 16 (primary transfer). Then, a composite color image (color transfer image) is formed by superimposing the black image, the yellow image, the magenta image, and the cyan image on the intermediate transfer member 50.

Meanwhile, in the paper feed table 200, one of paper feed rollers 142 is selectively rotated to feed a sheet (recording paper), from one of the paper feed cassettes 144 equipped in multiple stages in a paper bank 143. The recording paper is separated one by one by a separation roller 145 and sent to a sheet feed path 146. Each recording paper is conveyed by a conveying roller 147 and guided to a sheet feed path 148, and it stops by striking a resist roller 49. Alternatively, the paper feed roller 142 is rotated to feed a sheet (recording paper) on a manual feed tray 54. The recording paper is separated one by one by a separation roller 145 and guided to a manual sheet feeding path 153, and it stops by striking the resist roller 49. Here, the resist roller 49 generally used while grounded, but it may also be used in a state that a bias is applied for removing paper dust on the sheet. Thereafter, by rotating the resist roller 49 in accordance with the timing of the composite color image (color transfer image) formed on the intermediate transfer member 50, the sheet (recording paper) is fed between the intermediate transfer member 50 and a secondary transfer apparatus 22. By transferring the composite color image (color transfer image) on the sheet (recording paper) by the secondary transfer apparatus 22 (secondary transfer), a color image is transferred to and formed on the sheet (recording paper). Here, a residual toner on the intermediate transfer member 50 after the image transfer is cleaned by an intermediate transfer member cleaning apparatus 17.

The sheet (recording paper) on which the color image is transfer and formed is conveyed by the secondary transfer apparatus 22 and fed to a fixing apparatus 25, and in the fixing apparatus 25, the composite color image (color transfer image) is fixed on the sheet (recording paper) by heat and pressure. Thereafter, the sheet (recording paper) is switched by a switching claw 55 and discharged by a discharge roller 56, stacked on a discharge tray 57. Alternatively, the sheet (recording paper) is switched by the switching claw 55, inverted by the sheet inverting apparatus 28 and guided again to a transfer position. After an image is formed similarly on a rear surface as well, the sheet (recording paper) is discharged by the discharge roller 56 and stacked on the discharge tray 57.

EXAMPLES

Hereinafter, examples of the present invention are explained, but the present invention is not limited by these examples in any way. Methods for measuring various physical property values of components used in the example and comparative example are described below.

<Measurement of Molecular Weight>

Apparatus: GPC (manufactured by Tosoh Corporation)
Detector: RI
Measurement temperature: 40° C.,
Mobile phase: tetrahydrofuran
Flow rate: 0.45 mL/min.

Molecular weights Mn and Mw are number-average molecular weight and weight-average molecular weight, respectively, measured by GPC (gel permeation chromatography) with a calibration curve created by polystyrene samples with known molecular weights as a standard.

<Measurement of Glass Transition Temperature (Tg) of Binder Resin>

Apparatus: DSC (Q2000, manufactured by TA Instruments)
A sealed pan made of aluminum and filled with 5 mg to 10 mg of the binder resin was subjected to the following measurement flow.
1st Heating: 30° C. to 220° C., 5° C./min; maintaining for 1 minute after reaching to 220° C.

Cooling: quenching to −60° C. without temperature control; maintaining for 1 minute after reaching to −60° C.

2nd Heating: −60° C. to 180° C., 5° C./min.

Regarding a glass transition temperature (Tg), a glass transition temperature was obtained from the thermogram of the 2nd Heating by a mid-point method based on a method described in ASTM D3418/82. At this time, a glass transition temperature observed on a low-temperature side was defined as Tg1, and a glass transition temperature on a high-temperature side was defined as Tg2.

Differences in heat flows of baselines at two glass transition temperatures in the thermogram of the 2nd Heating were defined as h1 and h2, respectively, and h1 and h2 were obtained from the differences in endset points on a low-temperature side and a high-temperature side at each glass transition temperature, and a ratio (h1/h2) was calculated.

<Measurement of Average Diameter of First Phase Difference Images of Binder Resin>

Apparatus: AFM (MFP-3D, manufactured by Asylum Technology Co., Ltd.)

Cantilever: OMCL-AC240TS-C3

Target amplitude: 0.5V

Target percent: −5%

Amplitude setpoint: 315 mV

Scan rate: 1 Hz

Scan points: 256D256

Scan angle: 0°

A slice of a binder resin was obtained by cutting a block of the binder resin using an ultramicrotome (ULTRACUT UCT, manufactured by Leica) under the following conditions, and the binder resin was observed.

Cutting thickness: 60 nm

Cutting speed: 0.4 mm/sec

Diamond knife (ULTRA SONIC 35°) used

In a phase image of the binder resin observed by a Tapping Mode Atomic Force Microscope, an average diameter of the first phase difference images (i.e. soft, low-Tg unit) was calculated by selecting arbitrarily dispersion diameters having a large phase difference (i.e., soft, low-Tg unit) at 30 locations and by taking an average of maximum Feret's diameters thereof.

<Measurement of Presence or Absence of Ring-Containing Skeleton Molecule at End of Binder Resin>

Presence or absence of a ring-containing skeleton molecule at an end of a binder resin was measured using $^1$H-NMR (JOEL JNM400 FT NMR SYSTEM, manufactured by JEOL Ltd.). In a sample tube (high-precision NMR sample tube, manufactured by WILMAD), 1-% by mass deuterated chloroform solution of a toner was placed, and a peak derived from a double bond derived from an aromatic ring was confirmed.

Resin Precursor Synthesis Example 1

Synthesis of Resin Precursor

A flask was charged with 85.0 parts by mass of L-lactide, 15.0 parts by mass of D-lactide, and 6 parts by mass of cholesterol as an initiator, and a dehydration process was carried out under a reduced pressure condition while gradually increasing an internal temperature. Next, the temperature was further increased under $N_2$ purge. After it was visually confirmed that the system was homogenized, 0.03 parts by mass of tin 2-ethylhexanoate was charged in the system for a polymerization reaction. At this time, the internal temperature of the system was controlled so that it did not exceed 190° C. After 2 hours of the reaction time passed, the system was switched again to an outlet line, and non-reacted lactide was removed under a reduced pressure condition to complete the polymerization reaction. Thereby, Resin Precursor 1 was obtained.

Obtained Resin Precursor 1 had a number-average molecular weight (Mn) shown in Table 1.

Resin Precursor Synthesis Examples 2 to 7

Synthesis of Resin Precursors 2 to 7

Resin Precursors 2 to 7 were synthesized in the same manner as Resin Precursor Synthesis Example 1 except that the type and the amount of the initiator used in Resin Precursor Synthesis Example 1 was changed to those shown in Table 1.

Obtained Resin Precursors 2 to 7 had a number-average molecular weight (Mn) shown in Table 1.

TABLE 1

| | Initiator | | Number-average |
|---|---|---|---|
| | Type | Amount (parts by mass) | molecular weight Mn |
| Resin Precursor 1 | cholesterol | 6 | 3,000 |
| Resin Precursor 2 | cholesterol | 3 | 5,000 |
| Resin Precursor 3 | cholesterol | 2 | 7,000 |
| Resin Precursor 4 | Compound Q | 3 | 5,000 |
| Resin Precursor 5 | Compound R | 5 | 3,000 |
| Resin Precursor 6 | cholesterol | 9 | 2,000 |
| Resin Precursor 7 | cholesterol | 1 | 10,000 |

Compound Q and Compound R in Table 1 are shown below.

Compound Q

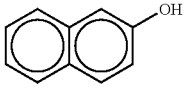

Compound R

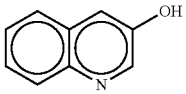

Polyester b Synthetic Example 1

Synthesis of Polyester b(1)

A 300-mL reactor equipped with a cooling tube, a stirrer, and a nitrogen inlet tube was charged with an alcohol component and an acid component at a proportion shown in Table 2 such that the total mass of the agents was 250 g. At that time, as a polymerization catalyst, titanium tetraisopropoxide (1,000 ppm with respect to the resin components) was added as well. In a nitrogen atmosphere, the system was heated to 200° C. over around 4 hours and then heated to 230° C. over 2 hours, and a reaction was carried out until there was no outflow component. Further thereafter, the reaction continued for 5 hours under a reduced pressure of 10 mmHg to 15 mmHg, and "Polyester b(1)" was obtained.

Obtained "Polyester b(1)" had a number-average molecular weight Mn and a glass transition temperature Tg as described in Table 3.

Polyester b Synthesis Examples 2 to 8

Synthesis of Polyesters b(2) to b(8)

"Polyesters b(2) to b(8)" were obtained in the same manner as Polyester b(1) in Synthesis Example 1 except that types and proportions of the alcohol component and the acid component for Polyester b(1) in Synthesis Example 1 were changed to those shown in Table 2.

Obtained "Polyesters b(2) to b(8)" had a number-average molecular weight (Mn) and a glass transition temperature (Tg) described in Table 3.

Polyester b Synthesis Example 9

Synthesis of Polyester b(9)

A 300-mL reactor equipped with a cooling tube, a stirrer, and a nitrogen inlet tube was charged with 43.8 parts by mass of 1,2-propylene glycol, 44.8 parts by mass of terephthalic acid dimethyl ester, 11.2 parts by mass of adipic acid, and 0.2 parts by mass of tetrabutoxy titanate as a polycondensation catalyst and reacted at 180° C. for 8 hours and then at 230° C. for 4 hours under a nitrogen atmosphere. The system was further reacted under a reduced pressure of 5 mmHg to 20 mmHg and taken out when its softening point reached 150° C. The resin taken out was cooled and then pulverized, and "Polyester b(9)" was obtained.

Obtained "Polyester b(9)" had a number-average molecular weight (Mn) and a glass transition temperature (Tg) described in Table 3.

TABLE 2

| | Alcohol component (% by mole) | | | Acid component (% by mole) | | | Molar ratio (hydroxyl group/ carboxyl group) OH/COOH |
|---|---|---|---|---|---|---|---|
| | 3-Methyl-1,5-pentanediol | 1,3-Propanediol | Neopentylglycol | Dimethyl adipate | Dimethyl terephthalate | Trimellitic anhydride | |
| Polyester b(1) | 70 | 30 | — | 80 | 17 | 3 | 1.20 |
| Polyester b(2) | 30 | 70 | — | 80 | 17 | 3 | 1.30 |
| Polyester b(3) | 30 | — | 70 | 80 | 17 | 3 | 1.30 |
| Polyester b(4) | 50 | 50 | — | 80 | 17 | 3 | 1.15 |
| Polyester b(5) | 70 | 30 | — | 37 | 60 | 3 | 1.20 |
| Polyester b(6) | 70 | 30 | — | 80 | 18.5 | 1.5 | 1.20 |
| Polyester b(7) | 70 | 30 | — | 80 | 20 | — | 1.20 |
| Polyester b(8) | 70 | 30 | — | 47 | 50 | 3 | 1.20 |

TABLE 3

| | Number-average molecular weight Mn | Glass transition temperature Tg (° C.) |
|---|---|---|
| Polyester b(1) | 4,000 | −6 |
| Polyester b(2) | 4,900 | −6 |
| Polyester b(3) | 3,000 | 23 |
| Polyester b(4) | 5,300 | 11 |
| Polyester b(5) | 4,500 | −33 |
| Polyester b(6) | 4,100 | −8 |
| Polyester b(7) | 4,200 | −6 |
| Polyester b(8) | 4,800 | −37 |
| Polyester b(9) | 2,100 | 50 |

Binder Resin Synthesis Example 1

Synthesis of Binder Resin 1

A flask was charged with 22.2 parts by mass of Polyester b(1) as a raw material for a skeleton B, and an internal temperature thereof was gradually raised. After it was visually confirmed that the system was homogenized, a dehydration process was carried out under a reduced pressure. Thereafter, ethyl acetate was added so as to be 50% by mass, and then 0.20 parts by mass of tin 2-ethylhexanoate and 3 parts by mass of isophorone diisocyanate. Then, the system was reacted while maintaining the temperature at 80° C. Thereafter, 77.8 parts by mass of Resin Precursor 3 was added as a resin precursor and reacted, and "Binder Resin 1" was obtained.

Obtained "Binder Resin 1" had a number-average molecular weight (Mn), a weight-average molecular weight (Mw), glass transition temperatures (Tg1, Tg2), a ratio (h1/h2), a maximum phase difference value in its phase image, a minimum phase difference value in its phase image, an average diameter of first phase difference images, and a presence or absence of a terminal ring-containing skeleton molecule described in Table 5-1 and Table 5-2.

Binder Resin Synthesis Examples 2 to 13 and 16 to 18

Synthesis of Binder Resins 2 to 13 and 16 to 18

"Binder Resins 2 to 13 and 16 to 18" were synthesized in the same manner as the binder resin in Synthesis Example 1 except that a type and an added amount of the resin precursor and the skeleton B (Polyester b) in Synthesis Example 1 were changed to those shown in Table 4.

Obtained "Binder Resins 2 to 13 and 16 to 18" had a number-average molecular weight (Mn), a weight-average molecular weight (Mw), glass transition temperatures (Tg1, Tg2), a ratio (h1/h2), a maximum phase difference value in its phase image, a minimum phase difference value in its phase image, an average diameter of first phase difference images, and a presence or absence of a terminal ring-containing skeleton molecule described in Table 5-1 and Table 5-2.

Binder Resin Synthesis Example 14

Synthesis of Binder Resin 14

An autoclave reactor equipped with a thermometer and a stirrer was charged with 1.3 parts by mass of lauryl alcohol as an initiator, 50 parts by mass of L-lactide, and 48.7 parts by mass of D-lactide, and it was further charged with 1% by mass by outer percentage of terephthalic acid titanium. After it was purged with nitrogen, the system was polymerized at 160° C. for 6 hours, and "Binder Resin 14" was synthesized.

Obtained "Binder Resin 14" had a number-average molecular weight (Mn), a weight-average molecular weight (Mw), glass transition temperatures (Tg1, Tg2), a ratio (h1/h2), a maximum phase difference value in its phase image, a minimum phase difference value in its phase image, an average diameter of first phase difference images, and a presence or absence of a terminal ring-containing skeleton molecule described in Table 5-1 and Table 5-2.

Binder Resin Synthesis Example 15

Synthesis of Binder Resin 15

An autoclave reactor equipped with a thermometer and a stirrer was charged with the "Polyester b(1)" as an initiator, 59.5 parts by mass of L-lactide and 10.5 parts by mass of D-lactide, and it was further charged with 1% by mass by outer percentage of terephthalic acid titanium. After it was purged with nitrogen, the system was polymerized at 160° C. for 6 hours, and "Binder Resin 15" was synthesized.

Obtained "Binder Resin 15" had a number-average molecular weight (Mn), a weight-average molecular weight (Mw), glass transition temperatures (Tg1, Tg2), a ratio (h1/h2), a maximum phase difference value in its phase image, a minimum phase difference value in its phase image, an average diameter of first phase difference images, and a presence or absence of a terminal ring-containing skeleton molecule described in Table 5-1 and Table 5-2.

A part of the fine particle dispersion was dried and a resin portion was isolated, and the resin portion had a glass transition temperature obtained by a flow tester measurement was 74° C.

—Preparation of Aqueous Medium—

An aqueous medium was prepared by mixing and stirring 300 parts by mass of ion-exchanged water, 300 parts by mass of the fine particle dispersion, and 0.2 parts by mass of sodium dodecylbenzenesulfonate for uniform dissolution.

—Preparation of Masterbatch—

Using a HENSCHEL mixer (manufactured by Mitsui Mining Co., Ltd.), 1,000 parts by mass of water, 530 parts by mass of carbon black (PRINTEX35, manufactured by Degussa; DBP oil absorption amount: 42 mL/100 g; pH: 9.5), and 1,200 parts by mass of Binder Resin 1 were mixed.

After it was kneaded using a twin roll at 150° C. for 30 minutes, the obtained mixture was cooled by rolling and pulverized with a pulverizer (manufactured by Hosokawa Micron Co., Ltd.), and a masterbatch was prepared.

TABLE 4

| | Resin Precursor | | | Skeleton B | | |
|---|---|---|---|---|---|---|
| | Type | Number-average molecular weight (Mn) | Added amount (parts by mass) | Type | Number-average molecular weight (Mn) | Added amount (parts by mass) |
| Binder Resin 1 | Resin Precursor 3 | 7,000 | 77.8 | Polyester b(1) | 4,000 | 22.2 |
| Binder Resin 2 | Resin Precursor 1 | 3,000 | 60.0 | Polyester b(1) | 4,000 | 40.0 |
| Binder Resin 3 | Resin Precursor 3 | 7,000 | 74.1 | Polyester b(2) | 4,900 | 25.9 |
| Binder Resin 4 | Resin Precursor 4 | 5,000 | 76.9 | Polyester b(3) | 3,000 | 23.1 |
| Binder Resin 5 | Resin Precursor 5 | 3,000 | 53.1 | Polyester b(4) | 5,300 | 46.9 |
| Binder Resin 6 | Resin Precursor 3 | 7,000 | 75.7 | Polyester b(5) | 4,500 | 24.3 |
| Binder Resin 7 | Resin Precursor 2 | 5,000 | 70.9 | Polyester b(6) | 4,100 | 29.1 |
| Binder Resin 8 | Resin Precursor 2 | 5,000 | 70.4 | Polyester b(7) | 4,200 | 29.6 |
| Binder Resin 9 | Resin Precursor 3 | 7,000 | 70.4 | Polyester b(8) | 4,200 | 29.6 |
| Binder Resin 10 | Resin Precursor 6 | 2,000 | 50.0 | Polyester b(1) | 4,000 | 50.0 |
| Binder Resin 11 | Resin Precursor 3 | 7,000 | 74.5 | Polyester b(8) | 4,800 | 25.5 |
| Binder Resin 12 | Resin Precursor 2 | 5,000 | 90.9 | DESMOPHEN 1200 | 1,000 | 9.1 |
| Binder Resin 13 | Resin Precursor 2 | 5,000 | 82.6 | Polyester b(9) | 2,100 | 17.4 |
| Binder Resin 16 | Resin Precursor 7 | 10,000 | 81.6 | Polyester b(5) | 4,500 | 18.4 |
| Binder Resin 17 | Resin Precursor 7 | 10,000 | 79.1 | Polyester b(4) | 5,300 | 20.9 |
| Binder Resin 18 | Resin Precursor 3 | 7,000 | 82.4 | Polyester b(3) | 3,000 | 17.6 |

*DESMOPHEN 1200 (polyester polyol, manufactured by Sumika Bayer Urethane Co., Ltd.)

Example 1

Preparation of Toner 1

—Production of Aqueous Dispersion of Resin Particles—

A reactor equipped with a stirring rod and a thermometer was charged with 600 parts by mass of water, 120 parts by mass of styrene, 100 parts by mass of methacrylic acid, 45 parts by mass of butyl acrylate, 10 parts by mass of sodium alkyl allyl sulfosuccinate (ELEMINOL JS-2, manufactured by Sanyo Chemical Industries, Ltd.), and 1 part by mass of ammonium persulfate, which was stirred at 400 revolutions/min for 20 minutes, and a white emulsion was obtained. This was heated until the system temperature was raised to 75° C. and reacted for 6 hours.

Further, 30 parts by mass of 1-% by mass aqueous solution of ammonium persulfate solution was added to the system, which was aged at 75° C. for 6 hours, and a fine particle dispersion as an aqueous dispersion of a vinyl resin (a copolymer of styrene-methacrylic acid-butyl methacrylate-sodium alkyl allyl sulfosuccinate) was obtained.

The obtained fine particle dispersion was measured using an electrophoretic light scattering photometer (ELS-800, manufactured by Otsuka Electronics Co., Ltd.), and its volume-average particle diameter was 0.08 μm.

—Preparation of Toner 1—

A reactor was charged with 100 parts by mass of Binder Resin 1 and 100 parts by mass of ethyl acetate, which was stirred, and Resin Solution 1 was prepared.

Next, Resin Solution 1 was charged with 5 parts by mass of carnauba wax (molecular weight: 1,800; acid value: 2.7 mgKOH/g; penetration: 1.7 mm (40° C.)) and 5 parts by mass of the prepared masterbatch, and a toner material solution was obtained by running 3 passes using a bead mill ("ULTRA VISCO MILL" manufactured by Aimex Co., Ltd.) under the following conditions: a liquid feed rate was 1 kg/hour; a peripheral speed of a disk was 6 m/second; and zirconia beads having a diameter of 0.5 mm were packed by 80% by volume.

Next, a container was charged with 150 parts by mass of the aqueous medium, and 100 parts by mass of the toner material solution was added while the container was stirred at 12,000 rpm using a TK HOMOMIXER (manufactured by Primix Corporation), and it was mixed for 10 minutes, and an emulsified slurry was obtained.

Further, a flask equipped with a stirrer and a thermometer was charged with 100 parts by mass of the emulsified slurry, which was subjected to desolvation at 30° C. for 10 hours while stirring at a peripheral speed of 20 m/min, and a dispersion slurry was obtained.

Next, 100 parts by mass of the obtained dispersion slurry was subjected to vacuum filtration, and 100 parts by mass of ion-exchanged water was added to an obtained filter cake. It was mixed using a TK HOMOMIXER at 12,000 rpm for 10 minutes, followed by filtration.

An operation that 300 parts by mass of ion-exchanged water was added to an obtained filter cake, which was mixed using a TK HOMOMIXER at 12,000 rpm for 10 minutes followed by filtration, was repeated twice. To an obtained filter cake, 20 parts by mass of 10-% by mass aqueous solution of sodium hydroxide was added, which was mixed using a TK HOMOMIXER at 12,000 rpm for 30 minutes, followed by vacuum filtration. To an obtained filter cake, 300 parts by mass of ion-exchanged water was added, which was mixed using a TK HOMOMIXER at 12,000 rpm for 10 minutes, followed by filtration. An operation that 300 parts by mass of ion-exchanged water was added to an obtained filter cake, which was mixed using a TK HOMOMIXER at 12,000 rpm for 10 minutes, followed by filtration was repeated twice. To an obtained filter cake, 20 parts by mass of 10-% by mass hydrochloric acid was added, which was mixed using a TK HOMOMIXER at 12,000 rpm for 10 minutes. Thereafter, a 5-% by mass methanol solution of a fluorine quaternary ammonium salt compound (FTERGENT F-310, manufactured by Neos Company Ltd.) was added such that the fluorine quaternary ammonium salt corresponds to 0.1 parts by mass with respect to 100 parts by mass of a solid content of the toner, which was stirred for 10 minutes, followed by filtration. An operation that 300 parts by mass of ion-exchanged water was added to an obtained filter cake, which was mixed using a TK HOMOMIXER at 12,000 rpm for 10 minutes, followed by filtration was repeated twice, and a filter cake was obtained.

Using a wind dryer, the obtained filter cake was dried at 40° C. for 36 hours and then sieved with a mesh having openings of 75 μm, and Toner Base Particles 1 were prepared.

Next, with respect to 100 parts by mass of Toner Base Particles 1, 1.5 parts by mass of hydrophobic silica (TS720, manufactured by Cabot) was added and blended in a HENSCHEL mixer at 3,000 rpm for 5 minutes, and Toner 1 was obtained.

Examples 2 to 10

Preparation of Toners 2 to 10

Toners 2 to 10 of Examples 2 to 10 were prepared in the same manner as Example 1 except that Binder Resin 1 in Example 1 was replaced by synthesized Binder Resins 2 to 9 and 16.

Comparative Examples 1 to 8

Preparation of Toners 11 to 18

Toners 11 to 18 of Comparative Examples 1 to 8 were prepared in the same manner as Example 1 except that Binder Resin 1 in Example 1 was replaced by synthesized Binder Resins 10 to 15 and 17 and 18.

—Preparation of Carrier—

A coat layer forming solution was prepared by adding 100 parts by mass of silicone resin (SR2411, manufactured by Dow Corning Toray Co., Ltd.), 5 parts by mass of γ-(2-aminoethyl)aminopropyltrimethoxysilane and 10 parts by mass of carbon black to 100 parts by mass of toluene, which was dispersed with a homomixer for 20 minutes. The coat layer forming solution was coated on a surface of 1,000 parts by mass of spherical magnetite having an average particle diameter of 50 μm using a fluidized-bed coating apparatus, and a magnetic carrier was prepared.

—Preparation of Developer—

Two-component developers of Examples 1 to 10 and Comparative Examples 1 to 8 were manufactured by mixing 5 parts by mass of the respective toners of Examples 1 to 10 and Comparative Examples 1 to 8 and 95 parts by mass of the carrier with a ball mill.

Next, each of the obtained developers was measured for its heat-resistant storage stability, low-temperature fixing property, toner scattering property, and background smear as follows. Results are shown in Table 5-3.

<Heat-Resistant Storage Stability (Penetration)>

Each toner was filled in a 50-mL glass container and left in a thermostatic bath at 50° C. for 24 hours and then cooled to 24° C. A penetration (mm) was measured in accordance with a penetration test (JIS K2235-1991) and evaluated based on the following criteria. Here, the larger penetration value indicates more superior heat-resistant storage stability, and the penetration of less than 5 mm is likely to cause problems on the use.

[Evaluation Criteria]

A: The penetration was 25 mm or greater.

B: The penetration was 15 mm or greater and less than 25 mm.

C: The penetration was 5 mm or greater and less than 15 mm.

D: The penetration was less than 5 mm.

<Low-Temperature Fixing Property (Lower-Limit Fixing Temperature)>

As an apparatus, a copying machine using a TEFLON (registered trademark) as a fixing roller (MF-200, manufactured by Ricoh Company, Ltd.) was remodeled so that a temperature of the fixing roller in a fixing unit may be varied. Each developer was mounted on the apparatus, and using this apparatus, a solid image having a toner added amount of $0.85 \pm 0.1$ mg/cm$^2$ was formed on transfer paper of plain paper and thick paper (TYPE 6200, manufactured by Ricoh Company, Ltd. and copying and printing paper <135>, manufactured by NBS Ricoh Co., Ltd.), and low-temperature fixing property was evaluated. A fixing test was conducted by varying the temperature of the fixing roller, and a lower-limit fixing temperature was defined as a temperature of the fixing roller at which a remaining ratio of image density after rubbing an obtained fixed image with a pad was 70% or greater, and it was evaluated based on the following criteria.

[Evaluation Criteria]

A: Lower-limit fixing temperature was less than 120° C.

B: Lower-limit fixing temperature was 120° C. or greater and less than 130° C.

C: Lower-limit fixing temperature was 130° C. or greater and less than 140° C.

D: Lower-limit fixing temperature was 140° C. or greater.

<Toner Scattering Property>

Using a tandem color image forming apparatus (IMAGIO NEO 450, manufactured by Ricoh Company, Ltd.), 30,000 sheets of a chart having an image area ratio of 7% was continuously output, and then a degree of toner contamination in the apparatus was visually evaluated at 4 levels based on the following criteria. The level of C or greater was practically usable.

[Evaluation Criteria]

A: The apparatus was in an excellent condition with no toner contamination at all.

B: The apparatus was in a preferable condition with no toner contamination.

C: The apparatus was practically usable despite toner contamination.

D: The apparatus was not practically usable with severe toner contamination.

<Background Smear>

Using a tandem color image forming apparatus (IMAGIO NEO 450, manufactured by Ricoh Company, Ltd.), 30,000 sheets of a chart having an image area ratio of 7% was continuously output, and then a degree of background smear in a background portion of the image was visually evaluated based on the following criteria. The level of C or greater was practically usable.

[Evaluation Criteria]

B: There was no occurrence of background smear in the background portion of the image.

C: There was some occurrence of background smear in the background portion of the image.

D: There was occurrence of background smear in the background portion of the image.

TABLE 5-1

| | Binder resin | | | | | |
|---|---|---|---|---|---|---|
| | No. | Number-average molecular weight Mn | Weight-average molecular weight Mw | Tg1 (° C.) | Tg2 (° C.) | Ratio (h1/h2) |
| Example 1 | 1 | 16,000 | 35,000 | 6 | 40 | 0.2 |
| Example 2 | 2 | 10,000 | 26,000 | 7 | 37 | 0.3 |

TABLE 5-1-continued

| | Binder resin | | | | | |
|---|---|---|---|---|---|---|
| | No. | Number-average molecular weight Mn | Weight-average molecular weight Mw | Tg1 (° C.) | Tg2 (° C.) | Ratio (h1/h2) |
| Example 3 | 3 | 19,000 | 42,000 | 3 | 42 | 0.25 |
| Example 4 | 4 | 12,000 | 30,000 | 17 | 42 | 0.41 |
| Example 5 | 5 | 10,000 | 23,000 | 11 | 44 | 0.33 |
| Example 6 | 6 | 23,000 | 40,000 | −18 | 43 | 0.16 |
| Example 7 | 7 | 17,000 | 28,000 | 4 | 41 | 0.21 |
| Example 8 | 8 | 16,000 | 31,000 | 8 | 39 | 0.22 |
| Example 9 | 9 | 11,000 | 23,000 | 15 | 40 | 1.2 |
| Example 10 | 16 | 20,000 | 45,000 | 5 | 63 | 0.3 |
| Comparative Example 1 | 10 | 9,000 | 21,000 | 3 | 33 | 0.23 |
| Comparative Example 2 | 11 | 20,000 | 38,000 | −27 | 43 | 0.18 |
| Comparative Example 3 | 12 | 10,000 | 22,000 | — | 42 | — |
| Comparative Example 4 | 13 | 12,000 | 29,000 | — | 45 | — |
| Comparative Example 5 | 14 | 12,000 | 25,000 | — | 45 | — |
| Comparative Example 6 | 15 | 16,000 | 35,000 | 6 | 40 | 0.2 |
| Comparative Example 7 | 17 | 24,000 | 50,000 | 6 | 68 | 0.2 |
| Comparative Example 8 | 18 | 18,000 | 37,000 | 23 | 40 | 0.2 |

TABLE 5-2

| | Binder resin | | | | | |
|---|---|---|---|---|---|---|
| | No. | Maximum value of phase difference in phase image | Minimum value of phase difference in phase image | Boundary value | Average diameter of first phase difference images (nm) | Presence of terminal ring-containing skeleton molecule |
| Example 1 | 1 | 66 | 54 | 60 | 50 | Yes |
| Example 2 | 2 | 65 | 53 | 59 | 75 | Yes |
| Example 3 | 3 | 62 | 51 | 56.5 | 55 | Yes |
| Example 4 | 4 | 61 | 50 | 55.5 | 80 | Yes |
| Example 5 | 5 | 63 | 51 | 57 | 70 | Yes |
| Example 6 | 6 | 64 | 53 | 58.5 | 65 | Yes |
| Example 7 | 7 | 62 | 53 | 57.5 | 69 | Yes |
| Example 8 | 8 | 62 | 54 | 58 | 100 | Yes |
| Example 9 | 9 | 64 | 51 | 57.5 | 150 | Yes |
| Example 10 | 16 | 31 | 50 | 40.5 | 80 | Yes |
| Comparative Example 1 | 10 | 61 | 52 | 56.5 | 78 | Yes |
| Comparative Example 2 | 11 | 63 | 54 | 58.5 | 70 | Yes |
| Comparative Example 3 | 12 | — | — | — | Not confirmed | Yes |
| Comparative Example 4 | 13 | — | — | — | Not confirmed | Yes |
| Comparative Example 5 | 14 | — | — | — | Not confirmed | No |
| Comparative Example 6 | 15 | 62 | 53 | 57.5 | 50 | No |
| Comparative Example 7 | 17 | 62 | 53 | 57.5 | 50 | Yes |
| Comparative Example 8 | 18 | 61 | 61 | 61 | 66 | Yes |

TABLE 5-3

| | Heat-resistant storage stability | Low-temperature fixing property | Toner scattering property | Background smear |
|---|---|---|---|---|
| Example 1 | A | A | B | B |
| Example 2 | A | A | A | B |
| Example 3 | A | A | A | B |
| Example 4 | A | A | B | B |
| Example 5 | A | A | B | B |
| Example 6 | A | B | B | B |
| Example 7 | B | A | A | B |
| Example 8 | C | A | C | B |
| Example 9 | B | B | C | C |
| Example 10 | B | B | C | B |
| Comparative Example 1 | D | B | C | C |
| Comparative Example 2 | D | A | D | D |
| Comparative Example 3 | A | D | B | B |
| Comparative Example 4 | B | C | C | D |
| Comparative Example 5 | D | D | D | D |
| Comparative Example 6 | B | A | C | D |
| Comparative Example 7 | C | B | C | D |
| Comparative Example 8 | D | B | C | D |

The following was confirmed from the results of Tables 5-1 to 5-3. In the differential scanning calorimetry (DSC) measurement of the binder resins at a heating speed of 5° C./min, glass transition temperatures Tg1 and Tg2 were observed at two locations in a predetermined temperature range. An average diameter of the binder resins in a phase image (first phase difference images) observed by Tapping Mode Atomic Force Microscope (AFM) was less than 100 nm. All the toners of Examples 1 to 9 using the binder resins in which a ring-containing skeleton molecule was introduced at ends thereof demonstrated a high level of favorable low-temperature fixing property, a wide temperature region for fixing as well as heat-resistant storage stability, and they also enabled a favorable print image even under mechanical stress during long continuous printing.

On the other hand, the glass transition temperature Tg2 of Comparative Example 1 was low, which degraded heat-resistant storage stability.

Also, the glass transition temperature Tg1 of Comparative Example 2 was low, which was effective for low-temperature fixing property but degraded heat-resistant storage stability.

Also, in Comparative Example 3, the skeleton B used as the initiator had a sufficiently low Tg, but based on the DSC measurement and the result of the Tapping Mode AFM, the binder resin synthesized did not have a structure that the low-Tg unit was dispersed internally. It was confirmed that favorable low-temperature fixing property did not develop.

Also, in Comparative Example 4, the skeleton B used as the initiator had a high Tg, and it didn't have a dispersion structure of coexisting soft and hard portions of the binder resin observed by the Tapping Mode AFM. As a result, low-temperature fixing property could not be obtained.

Also, in Comparative Example 5, since the polylactic acid resin used was obtained by the ring-opening polymerization from one end, a skeleton with a phase-separation structure was not obtained. Thus, desired properties could not be obtained in terms of lower-limit fixing temperature, heat-resistant storage stability, toner scattering property, and background smear.

Also, in Comparative Example 6, the average diameter of the first phase difference images was less than 100 nm, and the results of both low-temperature fixing property and heat-resistant storage stability were favorable. However, since the binder resin did not have a ring-containing skeleton molecule at ends thereof, mechanical strength as a toner was weak compared to the toners of the Examples. Thus, desired properties could not be obtained in terms of toner scattering property and background smear.

Aspects of the present invention are as follows.

<1> A toner, including at least:

a binder resin; and a colorant, wherein the binder resin has two glass transition temperatures Tg1 and Tg2 in a differential scanning calorimetry at a heating speed of 5° C./min, the glass transition temperature Tg1 is −20° C. to 20° C., and the glass transition temperature Tg2 is 35° C. to 65° C., wherein the binder resin includes a polyester skeleton and a ring-containing skeleton molecule at ends thereof, and wherein the binder resin is obtained by block copolymerization of:

a polyester skeleton A which includes a structural unit obtained by dehydration condensation of a hydroxycarboxylic acid in a repeating structure; and a skeleton B which does not include a structural unit obtained by dehydration condensation of a hydroxycarboxylic acid in a repeating structure.

<2> The toner according to <1>, wherein a ratio h1/h2, where h1 is a difference in a heat flow between baselines at the glass transition temperature Tg1, and h2 is a difference in a heat flow between baselines at the glass transition temperature Tg2, is less than 1.0.

<3> The toner according to any one of <1> to <2>, wherein a binarized image obtained by a binarization process of a phase image of the binder resin observed by a Tapping Mode Atomic Force Microscope at an intermediate boundary value of a maximum value and a minimum value of phase differences in the phase image includes first phase difference images each composed of a region having a larger phase difference than the boundary value and a second phase difference image composed of a region having a smaller phase difference than the boundary value, wherein the first phase difference images are dispersed in the second phase difference image, and wherein an average diameter of the first phase difference images is less than 100 nm.

<4> The toner according to any one of <1> to <3>, wherein the skeleton B which does not include a structural unit obtained by dehydration condensation of a hydroxycarboxylic acid in a repeating structure is polyester which does not include a structural unit obtained by dehydration condensation of a hydroxycarboxylic acid in a repeating structure.

<5> The toner according to <4>, wherein the polyester which does not include a structural unit obtained by dehydration condensation of a hydroxycarboxylic acid in a repeating structure has a branched structure.

<6> The toner according to any one of <1> to <5>, wherein the skeleton B in the binder resin has a mass ratio of 25% by mass to 50% by mass.

<7> The toner according to any one <1> to <6>, wherein the binder resin has a number-average molecular weight Mn of 20,000 or less.

<8> The toner according to any one of <1> to <7>, wherein the skeleton B in the binder resin has a number-average molecular weight of 3,000 to 5,000.

<9> A developer, including:

the toner according to any one of <1> to <8>; and a carrier.

<10> An image forming apparatus, including at least:

an electrostatic latent image bearing member;

an electrostatic latent image forming unit, which forms an electrostatic latent image on the electrostatic latent image bearing member;

a developing unit, which develops the electrostatic latent image using a toner and forms a visible image;

a transfer unit, which transfers the visible image to a recording medium; and a fixing unit, which fixes a transfer image transferred to the recording medium, wherein the toner is the toner according to any one of <1> to <8>.

This application claims priority to Japanese application No. 2011-288511, filed on Dec. 28, 2011 and incorporated herein by reference.

What is claimed is:

1. A toner, comprising:

a binder resin; and a colorant, wherein the binder resin has two glass transition temperatures Tg1 and Tg2 in a differential scanning calorimetry at a heating speed of 5° C./min, the glass transition temperature Tg1 is −20° C. to 20° C., and the glass transition temperature Tg2 is 35° C. to 65° C., wherein the binder resin comprises a polyester skeleton and a ring-containing skeleton molecule at ends thereof, wherein the binder resin is obtained by block copolymerization of:

a polyester skeleton A which includes a structural unit obtained by dehydration condensation of a hydroxycarboxylic acid in a repeating structure; and a skeleton B which does not include a structural unit obtained by dehydration condensation of a hydroxycarboxylic acid in a repeating structure.

2. The toner according to claim 1, wherein a ratio h1/h2, where h1 is a difference in a heat flow between baselines at the glass transition temperature Tg1, and h2 is a difference in a heat flow between baselines at the glass transition temperature Tg2, is less than 1.0.

3. The toner according to claim 1, wherein the skeleton B which does not include a structural unit obtained by dehydration condensation of a hydroxycarboxylic acid in a repeating structure is a polyester which does not include a structural unit obtained by dehydration condensation of a hydroxycarboxylic acid in a repeating structure.

4. The toner according to claim 3, wherein the polyester which does not include the structural unit obtained by dehydration condensation of a hydroxycarboxylic acid in a repeating structure has a branched structure.

5. The toner according to claim 1, wherein the skeleton B in the binder resin has a mass ratio of 25% by mass to 50% by mass.

6. The toner according to claim 1, wherein the binder resin has a number-average molecular weight Mn of 20,000 or less.

7. The toner according to claim 1, wherein the skeleton B in the binder resin has a number-average molecular weight of 3,000 to 5,000.

8. A developer comprising:

a toner comprising a binder resin and a colorant, wherein the binder resin has two glass transition temperatures Tg1 and Tg2 in a differential scanning calorimetry at a heating speed of 5° C./min, the glass transition temperature Tg1 is −20° C. to 20° C., and the glass transition temperature Tg2 is 35° C. to 65° C., wherein the binder resin comprises a polyester skeleton and a ring-containing skeleton molecule at ends thereof, wherein the binder resin is obtained by block copolymerization of:

a polyester skeleton A which includes a structural unit obtained by dehydration condensation of a hydroxycarboxylic acid in a repeating structure; and a skeleton B which does not include a structural unit obtained by dehydration condensation of a hydroxycarboxylic acid in a repeating structure.

* * * * *